US009060226B2

(12) United States Patent
Suzuki et al.

(10) Patent No.: US 9,060,226 B2
(45) Date of Patent: Jun. 16, 2015

(54) SPEAKER

(76) Inventors: Nobukazu Suzuki, Kanagawa (JP); Masaru Uryu, Chiba (JP); Yoshio Ohashi, Kanagawa (JP)

( * ) Notice: Subject to any disclaimer, the term of this patent is extended or adjusted under 35 U.S.C. 154(b) by 724 days.

(21) Appl. No.: 13/211,073

(22) Filed: Aug. 16, 2011

(65) Prior Publication Data

US 2012/0063633 A1 Mar. 15, 2012

Related U.S. Application Data

(63) Continuation of application No. 11/698,172, filed on Jan. 26, 2007, now abandoned.

(30) Foreign Application Priority Data

Jan. 30, 2006 (JP) ..... 2006-021350

(51) Int. Cl.
*H04R 1/00* (2006.01)
*H04R 1/24* (2006.01)

(52) U.S. Cl.
CPC ..... *H04R 1/24* (2013.01); *H04R 2440/07* (2013.01)

(58) Field of Classification Search
USPC ..... 381/332, 338, 423
See application file for complete search history.

(56) References Cited

U.S. PATENT DOCUMENTS

| | | | | |
|---|---|---|---|---|
| 1,803,892 | A * | 5/1931 | Corrigan | 181/163 |
| 3,329,235 | A | 7/1967 | Shaper | |
| 3,945,461 | A * | 3/1976 | Robinson | 181/153 |
| 4,473,721 | A | 9/1984 | Klien | |
| 5,111,509 | A * | 5/1992 | Takeuchi et al. | 381/338 |
| 5,261,006 | A | 11/1993 | Nieuwendijk et al. | |
| 5,548,657 | A | 8/1996 | Fincham | |
| 6,002,781 | A | 12/1999 | Takayama et al. | |
| 6,079,515 | A | 6/2000 | Newman | |
| 6,522,760 | B2 * | 2/2003 | Azima et al. | 381/152 |
| 2004/0125971 | A1 | 7/2004 | Dodd | |

FOREIGN PATENT DOCUMENTS

| | | |
|---|---|---|
| EP | 1 408 717 | 4/2004 |
| GB | 452420 | 8/1936 |
| JP | 02-309799 | 12/1990 |
| JP | 04-313999 | 11/1992 |
| JP | 05-145983 | 6/1993 |
| JP | 10-145892 | 5/1998 |
| JP | 11-113088 | 4/1999 |
| JP | 2001-136594 | 5/2001 |
| JP | 2001-333487 | 11/2001 |

(Continued)

OTHER PUBLICATIONS

English language Translation of Notification of Reasons for Refusal issued Dec. 28, 2010, from the Japanese Patent Office in corresponding Japanese Patent Application No. 2006-325772.

*Primary Examiner* — Duc Nguyen
*Assistant Examiner* — Taunya McCarty
(74) *Attorney, Agent, or Firm* — Finnegan, Henderson, Farabow, Garrett & Dunner, L.L.P.

(57) ABSTRACT

A speaker has an acoustic diaphragm, and an actuator that is driven based on a first acoustic signal. The actuator has a transmission portion that is directly or indirectly attached to the acoustic diaphragm and transmits a displacement output of the actuator to the acoustic diaphragm. The speaker also has a sounding body that is driven based on a second acoustic signal that is identical to or different from the first acoustic signal.

10 Claims, 25 Drawing Sheets

(56) References Cited

FOREIGN PATENT DOCUMENTS

| | | |
|---|---|---|
| JP | 2004-135294 | 4/2004 |
| JP | 2004-135295 | 4/2004 |
| JP | 2005-502288 | 1/2005 |
| JP | 2007-166027 | 6/2007 |
| WO | WO 03-023762 | 3/2003 |
| WO | WO 2004-066672 | 8/2004 |
| WO | WO 2004-110096 | 12/2004 |

* cited by examiner

SPEAKER

CROSS REFERENCE TO RELATED PATENT APPLICATIONS

This application is a continuation application of prior application Ser. No. 11/698,172, filed Jan. 26, 2007, which claims benefit of Japanese Patent Application No. 2006-021350 filed on Jan. 30, 2006, and Japanese Patent Application No. 2006-325772, filed on Dec. 1, 2006.

BACKGROUND OF THE INVENTION

1. Field of the Invention

The present invention relates to a speaker.

2. Description of Related Art

Japanese Patent Application Publication No. H04-313999 has disclosed a speaker, in which a magnetostrictive actuator is used to vibrate with a diaphragm, thereby obtaining an acoustic output sound. The magnetostrictive actuator is referred to as an actuator in which a magnetostrictive element whose form can alter by applying an external magnetic field thereto is used.

FIG. 1 shows a configuration of an acoustic output device 300 for outputting an acoustic sound. This acoustic output device 300 has a player 301, an amplifier 302, a magnetostrictive actuator 303, and a diaphragm 304. In this device 300, the magnetostrictive actuator 303 and the diaphragm 304 constitutes a speaker 305.

The player 301 reproduces, for example, an acoustic signal from a compact disc (CD), a mini disc (MD), a digital versatile disc (DVD) and outputs it. The amplifier 302 receives this acoustic signal from the player 301 and then, amplifies and supplies it to the magnetostrictive actuator 303. The magnetostrictive actuator 303 has a driving rod 303*a* for transmitting any displacement outputs. A tip of the driving rod 303*a* is attached to the diaphragm 304.

The magnetostrictive actuator 303 drives the diaphragm 304 based on the acoustic signal. In other words, the driving rod 303*a* of the magnetostrictive actuator 303 is displaced corresponding to a waveform of the acoustic signal, so that this displacement can be transmitted to the diaphragm 304. This enables the diaphragm 304 to output an acoustic sound corresponding to the acoustic signal.

SUMMARY OF THE INVENTION

In the above speaker 305 of the acoustic output device 300, however, it has been difficult to obtain any large amplitude (a large stroke) in the vibration. It may be thus hard for the speaker 305 to radiate a satisfied acoustic output sound of low frequency range as compared with an acoustic output sound of high frequency range.

It is desirable to provide a speaker that is capable of radiating the satisfied acoustic output sound.

According to an embodiment of the present invention, there is provided a speaker having an acoustic diaphragm, an actuator that is driven based on a first acoustic signal, and a sounding body. The actuator contains a transmission portion that transmits a displacement output of the actuator to the acoustic diaphragm. The transmission portion is attached to the acoustic diaphragm either directly or indirectly. The sounding body is driven based on a second acoustic signal that is identical to or different from the first acoustic signal.

In the speaker according to this embodiment of the invention, the actuator is driven based on the first acoustic signal and vibrates with the acoustic diaphragm. Thus, the acoustic diaphragm radiates an acoustic output sound based on the first acoustic signal. The sounding body such as a speaker unit using an electrodynamic actuator is driven based on a second acoustic signal. Thus, the sounding body radiates an acoustic output sound based on the second acoustic signal.

For example, when the first acoustic signal relates to a signal with a high frequency component, the acoustic diaphragm radiates an acoustic output sound with a high frequency component. In this moment, since large amplitude (large stroke) is not required therefor, the acoustic diaphragm can radiate a satisfied acoustic output sound with the high frequency component.

For example, when the second acoustic signal relates to a signal with a low frequency component, the sounding body radiates an acoustic output sound with a low frequency component. In this moment, since the sounding body such as a speaker unit may get large amplitude (large stroke), the sounding body can radiate a satisfied acoustic output sound with the low frequency component. This enables the speaker as a whole to radiate a satisfied acoustic output sound with the high and low frequency components.

According to the embodiment, a transmission portion of the actuator that transmits a displacement output of the actuator to the acoustic diaphragm is attached to the acoustic diaphragm either directly or indirectly. The actuator vibrates with the acoustic diaphragm by at least its component of vibration along a direction of a plane of the acoustic diaphragm. In this embodiment, as a displacement direction of the transmission portion of the actuator approaches to a direction of the plane of the acoustic diaphragm, a vibration component along the direction of the plane of the acoustic diaphragm is increased. For example, when the acoustic diaphragm has an end surface, the actuator vibrates with the acoustic diaphragm by at least its component of vibration orthogonal to the end surface of the acoustic diaphragm.

The actuator vibrates with the acoustic diaphragm by its component of the vibration along a plane of the acoustic diaphragm, which is a component of vibration parallel to the plane of the acoustic diaphragm, so that an elastic wave based on an acoustic signal propagates in the plane direction of the acoustic diaphragm. This elastic wave repeats mode exchanges of a longitudinal wave to a transverse wave and vice versa when the elastic wave propagates in the acoustic diaphragm, so that the longitudinal wave and the transverse wave can be mingled therein. The transverse wave excites vibration along a plane direction of an acoustic diaphragm (i.e., a direction orthogonal to the end surface of the acoustic diaphragm). This enables the diaphragm to emit sound wave to an outside, thereby obtaining an acoustic output sound.

Thus, the actuator vibrates with the acoustic diaphragm by its component of the vibration along a plane of the acoustic diaphragm, which prevents large transverse wave from occurring at a vibration point. Therefore, a listener does not listen to sound wave from the vibration point being sounded very loud, as compared by that from another position, so that an acoustic image can be spread to the whole of the acoustic diaphragm. This causes a global acoustic image to be obtained.

In an embodiment of a speaker according to the invention, plural actuators can be provided. The transmission portions of the plural actuators are respectively attached to the acoustic diaphragm at different positions thereof. For example, when the plural actuators are driven on the basis of the same acoustic signal, the speaker can get an omni-directionality. When the plural actuators are respectively driven on the basis of the separate acoustic signals, for example, multi-channel acoustic signals or plural acoustic signals that are acquired by adjusting an identical acoustic signal on its level, its delay time, its frequency property separately, it is possible to perform any sound field processing so as to spread its acoustic image to the whole of the pipe member to get the listener a global acoustic image on the speaker.

In an embodiment of a speaker according to the invention, plural sounding bodies can be provided. The plural sounding bodies are respectively arranged at positions that are different from each other. The plural sounding bodies may be respectively arranged on a circumference of a base casing at predetermined angles apart from each other. Each of the sounding bodies reproduces its low frequency component so that less information on localization of acoustic image can be given therefrom. Accordingly, if the acoustic diaphragm reproduces its high frequency component, the speaker can get an omnidirectionality as a whole of the speaker system and create an acoustic image on the acoustic diaphragm.

In an embodiment of a speaker according to the invention, the acoustic diaphragm having a tube shape can be used as the acoustic diaphragm. The sounding body is arranged on one end side of the tubular acoustic diaphragm. Sound wave radiated from the sounding body is radiated to outside through an interior of the tubular acoustic diaphragm. In this moment, a direction of a center axis of the sounding body can be optionally set with respect to that of a center axis of the tubular acoustic diaphragm. For example, the direction of the center axis of the sounding body is set so that the direction of a center axis of the sounding body can be identical to that of the center axis of the acoustic diaphragm or orthogonal to that of a center axis of the acoustic diaphragm. The tubular acoustic diaphragm acts as a resonator for sound wave from the sounding body, thereby enabling any massive sound of low frequency range to be reproduced.

In this embodiment, the sound wave radiated from the sounding body is radiated from one end and the other end of the tubular acoustic diaphragm. Thus, such the radiation of the sound wave radiated from the opposed ends of the sounding body enables a listener to feel any even sound pressure from each position of the tubular acoustic diaphragm along a longitudinal direction thereof, thereby spreading its acoustic image to the whole of the tubular acoustic diaphragm to get the listener a global acoustic image on the speaker.

In an embodiment of a speaker according to the invention, the tubular acoustic diaphragm is configured so that it can have different diameters of its circular cross sections, which are gradually made larger toward a propagation direction of the sound wave from the sounding body. This causes electric inductance component to be increased to get a flat frequency property and a resonance dumping effect. This also enables an output of the tubular acoustic diaphragm, from which the sound wave radiates, to be enlarged as compared with a tubular acoustic diaphragm having no gradually enlarged diameters of its circular cross sections, thereby enhancing the spread of acoustic image.

In an embodiment of a speaker according to the invention, a tubular member can be arranged within an interior of the tubular acoustic diaphragm with the tubular member being away from the tubular acoustic diaphragm. The sounding body is arranged corresponding to the tubular member. Sound wave radiated from the sounding body is radiated to outside through an interior of the tubular member. In this embodiment, when the tubular member is formed as a rigid body, the speaker can implement a satisfied reproduction as an acoustic tube because any noisy vibration is not applied to the tubular member. Further, the speaker can intercept efficiently any noisy acoustic output sound (sound wave) that the tubular acoustic diaphragm radiates and which is oriented inwardly, by means of a closed space formed by the tubular acoustic diaphragm and the tubular member.

In an embodiment of a speaker according to the invention, the acoustic diaphragm having a cup shape can be used as the acoustic diaphragm. The transmission portion of the actuator is attached to an open end surface of the acoustic diaphragm having the cup shape. The sounding body is arranged on the open end surface side of the acoustic diaphragm. In this embodiment, a direction of a center axis of the sounding body is optionally set with respect to that of a center axis of the acoustic diaphragm. For example, a direction of the center axis of the sounding body is set so that a direction of the center axis of the sounding body can be identical to that of a center axis of the acoustic diaphragm or orthogonal to that of a center axis of the acoustic diaphragm. The acoustic diaphragm acts as an air chamber (a back cavity) of the sounding body, thereby enabling response property to be improved in low and middle frequency ranges.

Thus, according to the speaker of each of the above embodiments of the invention, the actuator(s) vibrate(s) with the acoustic diaphragm based on the first acoustic signal to output an acoustic sound and the sounding body (bodies) output(s) an acoustic sound based on the second acoustic signal, so that the speaker can radiate a satisfied output acoustic sound.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

DESCRIPTION OF THE PREFERRED EMBODIMENTS

Figure 1:
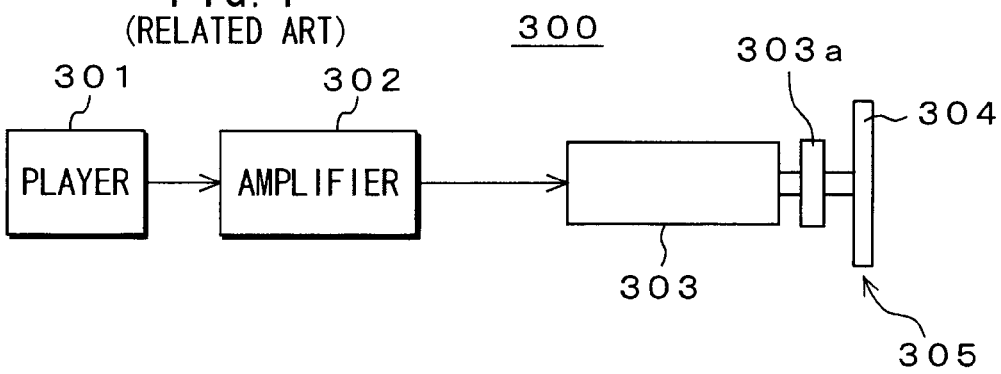
FIG. 1 (RELATED ART)
FIG. 1 is a block diagram for illustrating a configuration of an acoustic output device, as related art, in which a magnetostrictive actuator is used.
Figure 2:
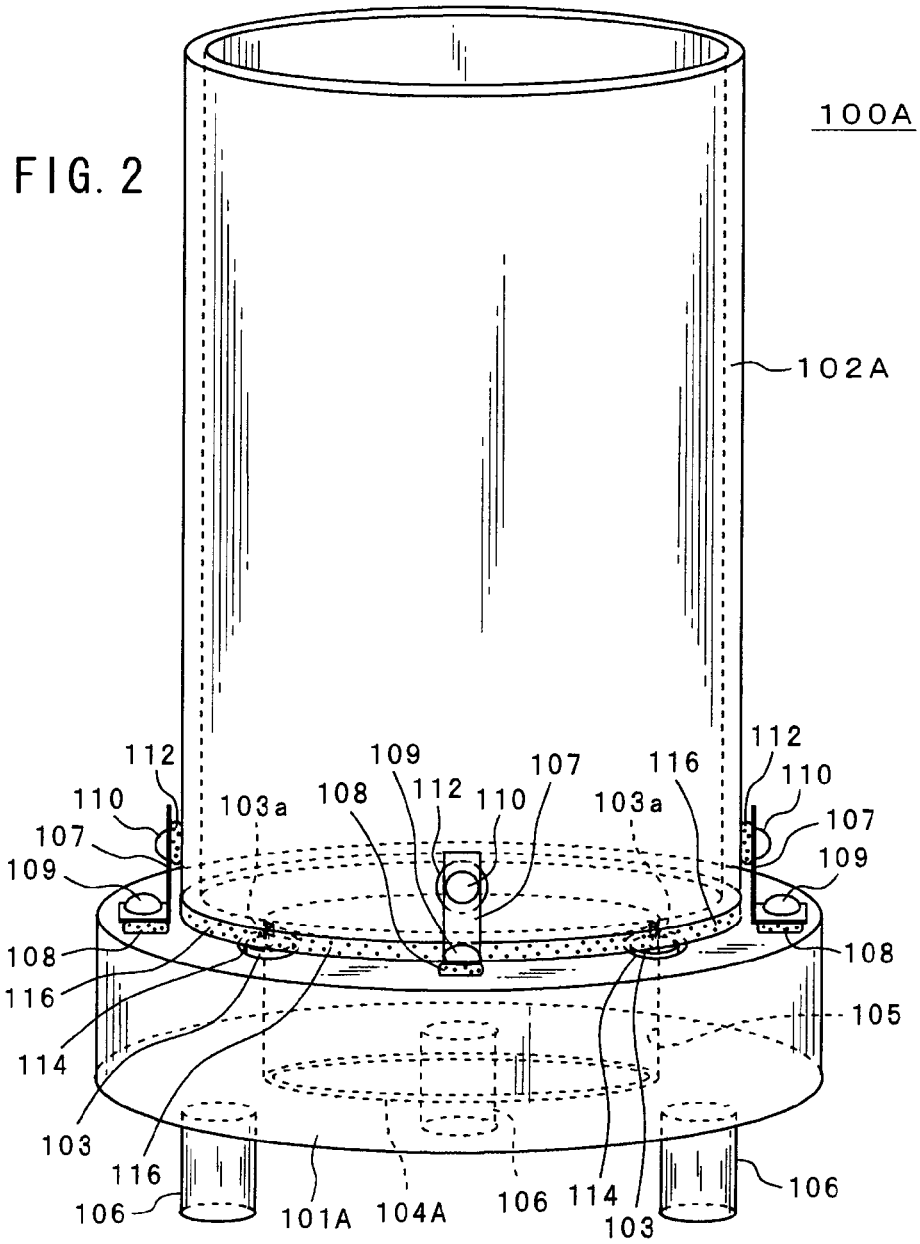
FIG. 2 is a perspective view of a speaker 100A according to a first embodiment of the invention.
Figure 3:
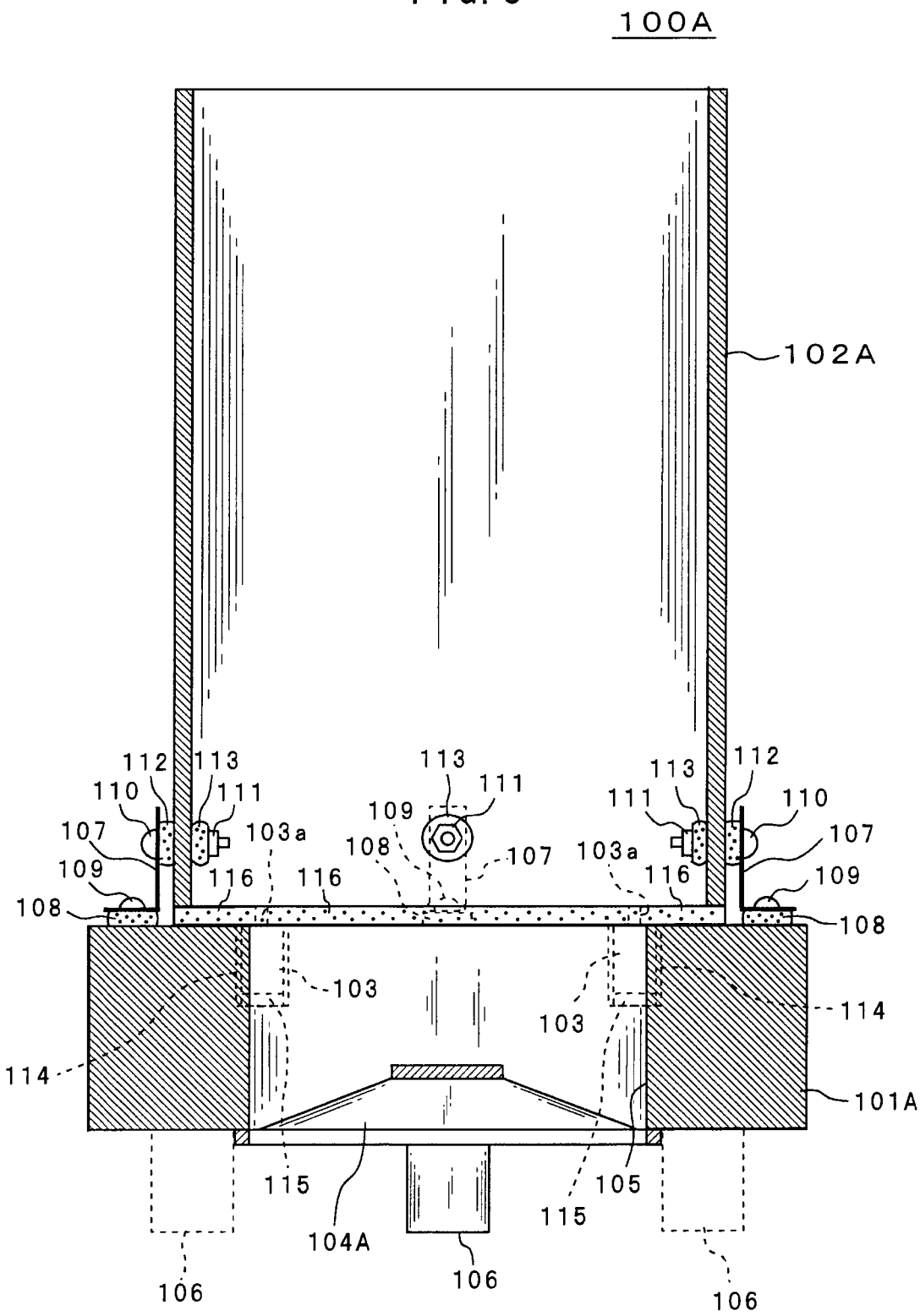
FIG. 3 is a vertical sectional view of the speaker 100A according to the first embodiment of the invention.
Figure 4A:
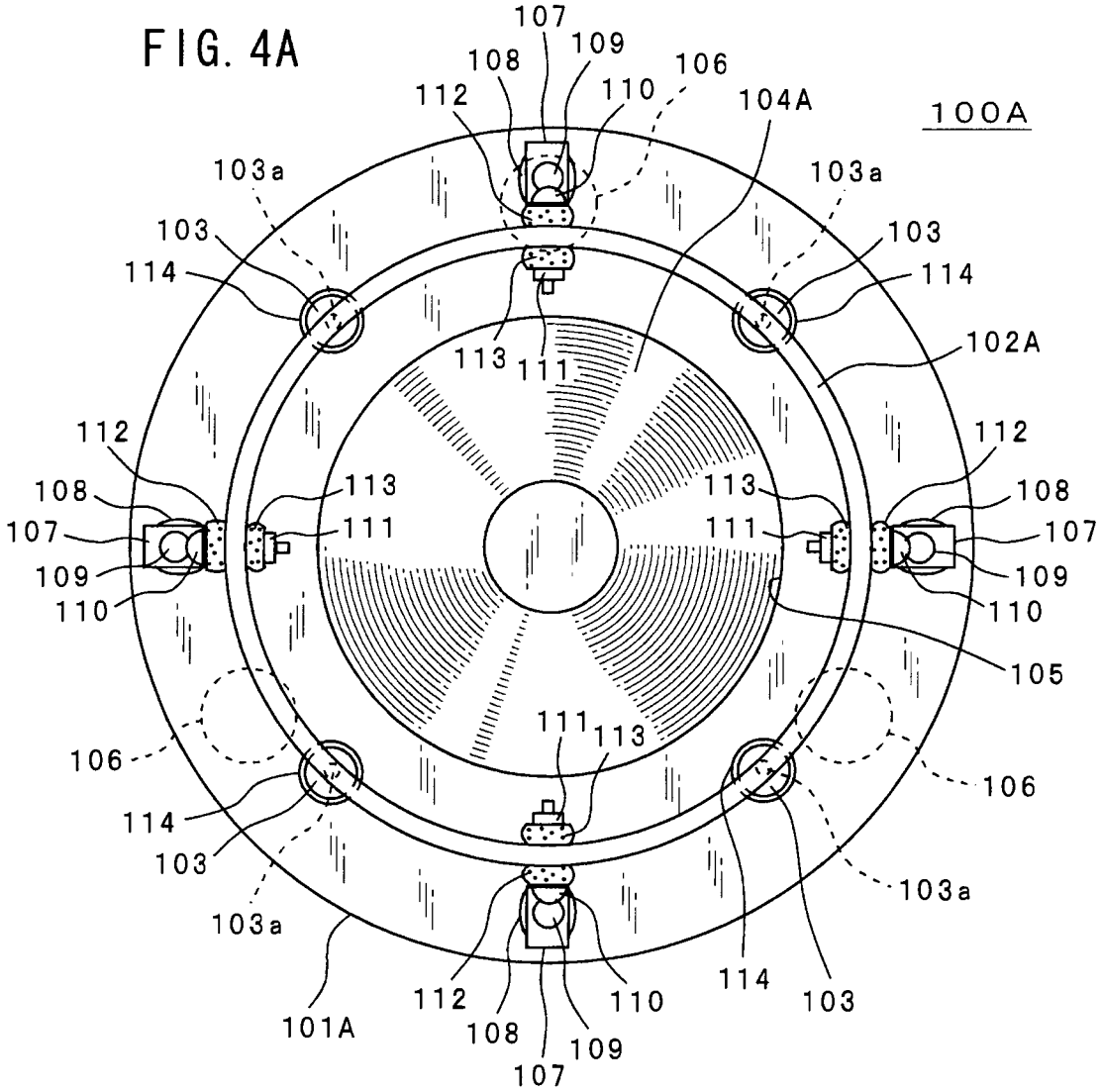
FIG. 4A is a top plan view of the speaker 100A according to the first embodiment of the invention and FIG. 4B is a top plan view of a damper member.
Figure 4B:
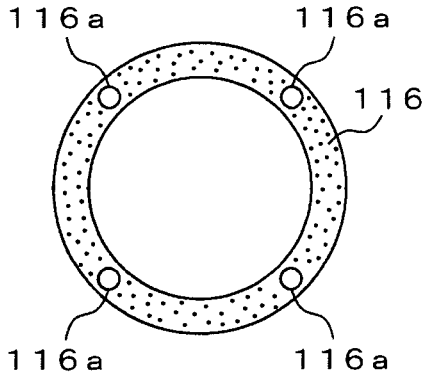
Figure 5:
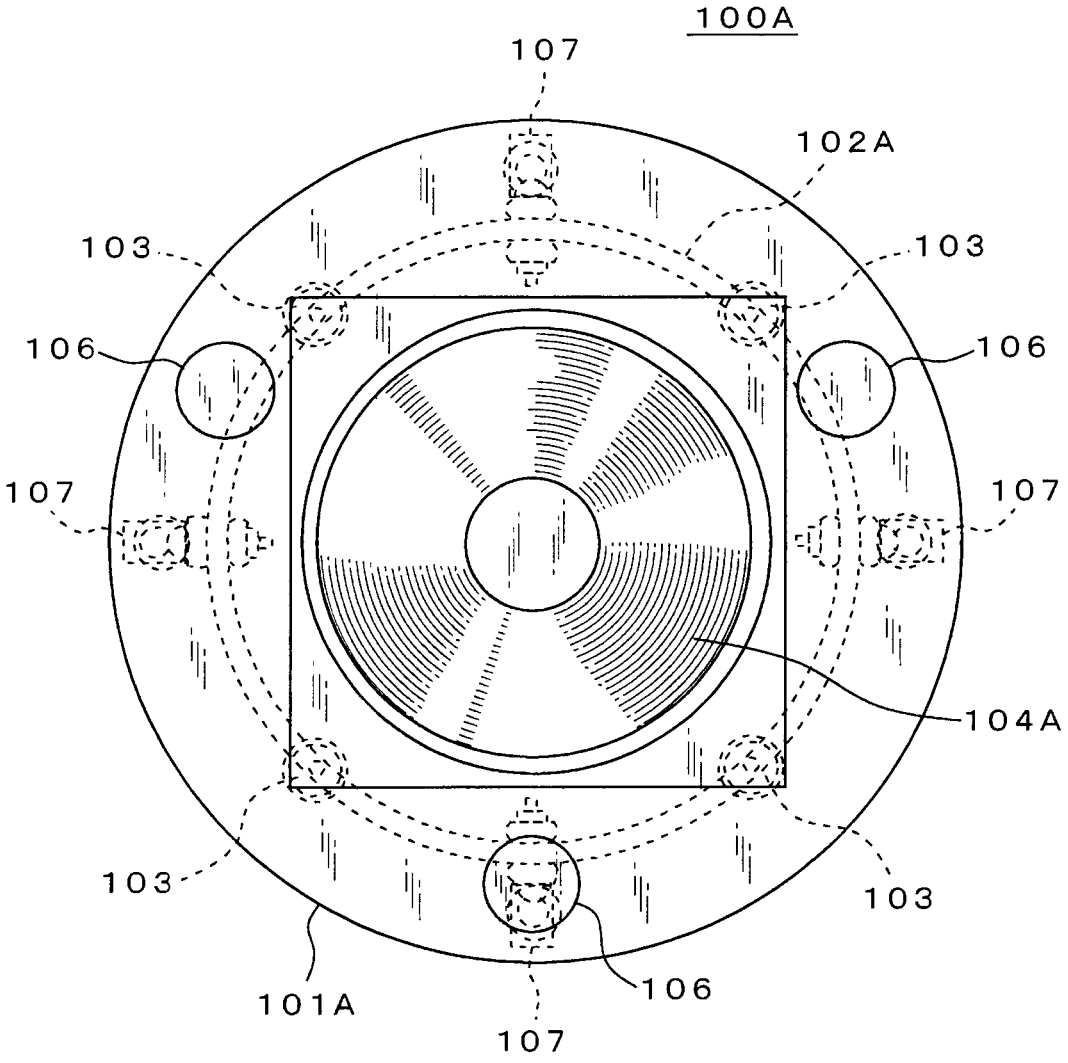
FIG. 5 is a bottom plan view of the speaker 100A according to the first embodiment of the invention.

The following will describe embodiments of the present invention with reference to the accompanied drawings. FIGS. 2 through 5 show a configuration of a speaker 100A according to a first embodiment of the invention. FIG. 2 is a perspective view of the speaker 100A according to the first embodiment of the invention; FIG. 3 is a vertical sectional view thereof; FIG. 4A is a top plan view thereof; and FIG. 5 is a bottom plan view thereof.

The speaker 100A has a base casing 101A, a pipe member 102A, magnetostrictive actuators 103 as actuators, and a speaker unit 104A in which an electrodynamic actuator is used as a sounding body. The pipe member 102A constitutes a tubular diaphragm as an acoustic diaphragm. A driving rod 103*a* of each of the magnetostrictive actuators 103 constitutes a transmission portion which transmits a displacement output of each of the magnetostrictive actuators 103.

The base casing 101A is made of, for example, synthetic resin. This base casing 101A has a disk-like shape as a whole and a cylindrical opening 105 passing through it at a center portion thereof. This base casing 101A also has a predetermined number of legs 106, in this embodiment, three legs, at the same angle intervals along a lower outer circumference portion thereof.

When the base casing 101A has three legs 106, it is possible to implement a more stable setting thereof than a case where the base casing 101A has, for example, four legs because these three legs 106 may be necessarily contacted to any places to be contacted. Further, providing a bottom surface of the base casing 101A with the legs 106 enables the bottom surface thereof to be away from the places to be contacted, thereby allowing sound wave radiated from the speaker unit 104A that is provided under the base casing 101A to radiate toward outside.

The pipe member 102A is made of, for example, a predetermined material such as a transparent acrylic resin. The pipe member 102A is set on the base casing 101A. Namely, a lower end portion of the pipe member 102A is set on a top surface of the base casing 101A at a plurality of positions, in this embodiment, four positions by using L-shaped metal angles 107. A size of the pipe member 102A relates to the one having, for example, a length of 1000 mm, a diameter of 100 mm, and a thickness of 2 mm.

In both ends of the L-shaped metal angles 107, round holes for a screw, not shown, are bored. An end of the L-shaped angle 107 is screwed to the top surface of the base casing 101A by a screw 109. Each screw hole, not shown, to which a screw thread of the screw 109 is secured is formed in the base casing 101A. The end of the L-shaped angle 107 is secured to the top surface of the base casing 101A through a damper member 108 constituted of ring-shaped rubber member or the like.

The other end of the L-shaped angle 107 is secured to a lower end portion of the pipe member 102A by a screw 110 and a nut 111. Each screw hole, not shown, to which a screw thread of the screw 110 is secured is formed in the lower end portion of the pipe member 102A. Damper members 112, 113 each constituted of ring-shaped rubber member or the like stand between the other end of the L-shaped angle 107 and an outer surface of the pipe member 102A and between the nut 111 and an inner surface of the pipe member 102A, respectively.

The damper members 108, 112, 113 thus intervened prevent any vibration (elastic wave) by the magnetostrictive actuators 103 from propagating to the base casing 101A through the pipe member 102A and the L-shaped angles 107, thereby avoiding localizing any acoustic image to the base casing 101A.

Plural magnetostrictive actuators 103, in this embodiment, four magnetostrictive actuators are set on the base casing 101A. These four magnetostrictive actuators 103 are positioned at the same intervals under and along a circular lower end surface of the pipe member 102A. On the top surface of the base casing 101A, hollows 114 each for containing the magnetostrictive actuator 103 are formed. The magnetostrictive actuators 103 are respectively set on the base casing 101A with them being respectively contained in the hollows 114.

Each of the magnetostrictive actuators 103 is set on a bottom surface of the hollow 114 in the base casing 101A through a damper member 115 constituted of ring-shaped rubber member or the like. The damper member 115 thus intervened prevents any vibration by the magnetostrictive actuator 103 from propagating to the base casing 101A, thereby avoiding localizing any acoustic image to the base casing 101A.

When each of the magnetostrictive actuators 103 is set on the base casing 101A with them being contained in the hollows 114 thereof, the driving rod 103*a* of each of the magnetostrictive actuators 103 is attached to the lower end surface of the pipe member 102A. In this moment, a displacement direction of each of the driving rods 103*a* is oriented to a direction orthogonal to the lower end surface of the pipe member 102A, namely, an axis direction of the pipe member 102A. This axis direction corresponds to a direction along a plane of the pipe member 102A (a direction parallel to the plane of the pipe member 102A). Such a configuration enables the magnetostrictive actuators 103 to vibrate with the lower end surface of the pipe member 102A by their component of the vibration that is orthogonal to the lower end surface of the pipe member 102A.

Figure 6:
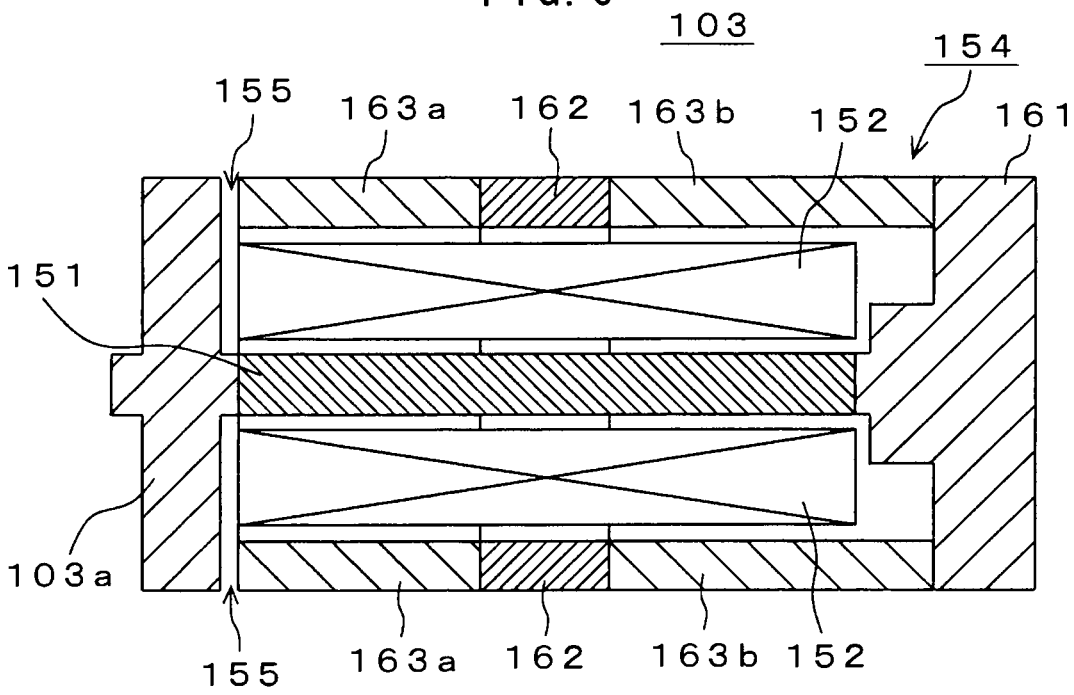
FIG. 6 is a sectional schematic view of a magnetostrictive actuator.

FIG. 6 shows a configuration of any one of the magnetostrictive actuators 103. This magnetostrictive actuator 103 has a rod-like magnetostrictive element 151 that is displaced along its extension direction, a solenoid coil 152 for generating a magnetic field in order to apply a control magnetic field to the magnetostrictive element 151, which is positioned around this magnetostrictive element 151, a driving rod 103*a* as driving member, which is connected to an end of the magnetostrictive element 151 and transmits any displacement output of the magnetostrictive actuator 103, and a container 154 that contains the magnetostrictive element 151 and the solenoid coil 152 therein.

The container 154 is constituted of a fixed disk foot 161, a permanent magnet 162, and tubular cases 163*a*, 163*b*. The other end of the magnetostrictive element 151 is connected to the fixed disk foot 161 so that the fixed disk foot 161 can support the magnetostrictive element 151. The permanent magnet 162 that applies a biased static magnetic field to the magnetostrictive element 151 and the tubular cases 163*a*, 163*b* that constitute a magnetic circuit are positioned around the magnetostrictive element 151 that they enclose. The tubular cases 163*a*, 163*b* are installed on both of sides, sides of the driving rod 103*a* and the fixed disk foot 161, of the permanent magnet 162. These tubular cases 163*a*, 163*b* are made of ferromagnetic materials so that the biased static magnetic field can be efficiently applied to the magnetostrictive element 151. If the fixed disk foot 161 is also made of ferromagnetic materials, the biased static magnetic field can be more efficiently applied to the magnetostrictive element 151.

There is a gap 155 between the driving rod 103*a* and the container 154. The driving rod 103*a* is made of ferromagnetic materials, so that it can be pulled by the permanent magnet 162 through the gap 155. Such a configuration enables the magnetic force of pull-in to occur between the driving rod 103*a* and the container 154. Thus, the magnetic force of pull-in allows a pre-load to be applied against the magnetostrictive element 151 connected to the driving rod 103*a*.

Figure 7:
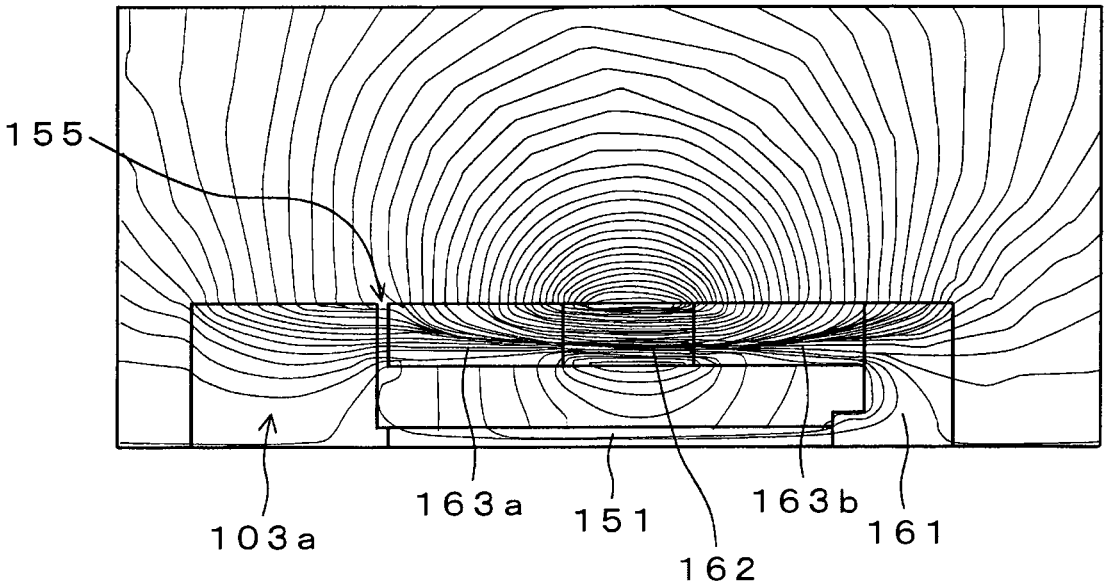
FIG. 7 is a diagram for showing lines of magnetic induction.

FIG. 7 shows lines of magnetic induction in the magnetostrictive actuator 103 shown in FIG. 6. The lines of magnetic induction started from the permanent magnet 162 pass through the tubular case 163*a*, the gap 155, the driving rod 103*a*, and the fixed disk foot 161 and return to the permanent magnet 162 via the tubular case 163*b*. This causes the magnetic force of pull-in to occur between driving rod 103*a* and the container 154 so that the magnetic force of pull-in allows a pre-load to be applied against the magnetostrictive element 151. A part of the lines of magnetic induction started from the permanent magnet 162 passes through the tubular case 163*a*, the gap 155, the driving rod 103*a*, the magnetostrictive element 151, and the fixed disk foot 161 and returns to the permanent magnet 162 via the tubular case 163*b*. This enables a biased static magnetic field to be applied to the magnetostrictive element 151.

In the magnetostrictive actuator 103, the driving rod 103*a* is not supported by a bearing. This enables no problem about a friction of the driving rod 103*a* with the bearing to arise, thereby reducing loss of the displacement output substantially.

In the magnetostrictive actuator 103, the magnetic force of pull-in allows a pre-load to be applied against the magnetostrictive element 151. This allows the pre-load to keep being stably applied thereto even if a period of the displacement by the magnetostrictive element 151 is short, thereby obtaining a proper displacement output based on the control current supplied to the solenoid coil 152.

Thus, in the magnetostrictive actuator 103, a relationship between the control current flown through the solenoid coil 152 and the displacement of the driving rod 103*a* comes closer to a linear one. This enables any distortion generated based on a characteristic of the magnetostrictive actuator 103 to be decreased, thereby reducing a burden of feedback adjustment.

In the magnetostrictive actuator 103, the permanent magnet 162 stands between two tubular cases 163*a*, 163*b* so that the biased static magnetic field can be more uniformly applied to the magnetostrictive element 151 as compared with a case where the permanent magnet is installed on a position of the fixed disk foot 161. In this embodiment, it may be not necessary to provide the magnetostrictive actuator 103 with any bearing for supporting the driving rod 103*a*, any coupling member for coupling the driving rod 103*a* to the container 154, any spring for applying a pre-load to the magnetostrictive element 151, and the like, thereby allowing the magnetostrictive actuator 103 to be easily downsized and manufactured at a low price.

The pipe member 102A and each of the magnetostrictive actuators 103 constitute a speaker component for high frequency range in an audio frequency band to act as a tweeter. The speaker unit 104A constitutes a speaker component for low frequency range in the audio frequency band to act as a woofer.

The speaker unit 104A is installed on the base casing 101A by using screws, not shown, with its front side being put upside down and its main body being received in the opening 105 at a lower end of the base casing 101A.

In this embodiment, the speaker unit 104A is arranged so that a direction of a center axis of the speaker unit 104A is identical to that of a center axis of the pipe member 102A. Sound wave of positive phase radiated from the front of the speaker unit 104A radiates to outside by passing through the bottom of the base casing 101A. Sound wave of negative phase radiated from the back of the speaker unit 104A radiates from an upper end of the pipe member 102A to outside by passing through the opening 105 and an interior of the pipe member 102A. In this embodiment, the pipe member 102A acts as a resonator, thereby enabling any massive sound of low frequency range to be reproduced.

A damper member 116 made of, for example, rubber material is arranged between the lower end surface of the pipe member 102A and the top surface of the base casing 101A. This damper member 116 has a ring shape as a whole as shown in FIG. 4B. The damper member 116 also has holes 116*a* through which the rods 103*a* of the magnetostrictive actuators 103 respectively pass. This damper member 116 prevents any vibration by the magnetostrictive actuators 103 from propagating to the base casing 101A through the pipe member 102A and enhances sealing by the pipe member 102A so that the pipe member 102A can act as the resonator excellently.

Figure 8:
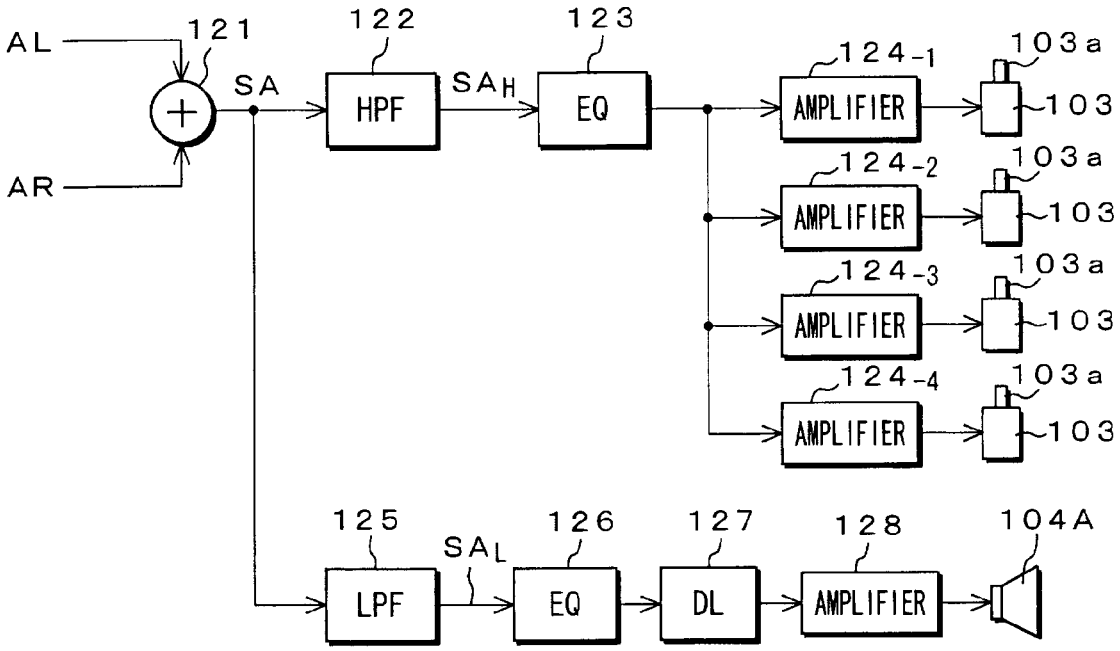
FIG. 8 is a block diagram for showing a configuration of a driving system for the magnetostrictive actuators and a speaker unit.

FIG. 8 shows a configuration of a driving system for the four magnetostrictive actuators 103 and the speaker unit 104A.

Left component AL and right component AR of the acoustic signal, which constitute a stereo acoustic signal, are supplied to an adder 121. The adder 121 adds these components AL, AR of the acoustic signal to each other to produce a monaural acoustic signal SA. A high-pass filter 122 receives the monaural acoustic signal SA and extracts its high frequency range component SAH therefrom. An equalizer 123 receives this high frequency range component SAH and adjusts its frequency characteristic so that it can correspond to the magnetostrictive actuators 103. Amplifiers 124-1 through 124-4 respectively receive and amplify the adjusted high frequency range component SAH to supply it to the four magnetostrictive actuators 103 as the control signal therefor. This enables the four magnetostrictive actuators 103 to be driven by the same high frequency range component SAH, so that their driving rods 103*a* can displace corresponding to the high frequency range component SAH.

A low-pass filter 125 receives the monaural acoustic signal SA and extracts its low frequency range component SAL therefrom. An equalizer 126 receives this low frequency range component SAL and adjusts its frequency characteristic so that it can correspond to the resonator constituted of the pipe member 102A. A delay circuit 127 receives and delays the adjusted low frequency range component SAL by some milliseconds. An amplifier 128 receives and amplifies the delayed low frequency range component SAL to supply it to the speaker unit 104A as the control signal therefor. This enables the speaker unit 104A to be driven by the low frequency range component SAL.

Inserting the delay circuit 127 into a supply path of the low frequency range component SAL to the speaker unit 104A enables to be delayed a point of time when sound wave of low frequency range radiates from the speaker unit 104A as compared with a point of time when sound wave of high frequency range radiates from the pipe member 102A. This causes a listener to be liable to feel an acoustic image on the pipe member 102A that radiates the sound wave of high frequency range based on listening characteristic of human being such that an acoustic image is depended on a high frequency range of the listened sound.

The following will describe operations of the speaker 100A shown in FIGS. 2 through 5.

The four magnetostrictive actuators 103 contained in and set on the base casing 101A are driven by the high frequency range component SAH of the monaural acoustic signal SA. Their driving rods 103*a* displace corresponding to the high frequency range component SAH. Based on the displacement of each of the driving rods 103*a*, the pipe member 102A vibrates by a component of the vibration by the driving rods 103*a* orthogonal to the lower end surface of the pipe member 102A (along a plane of the pipe member 102A).

The lower end surface of the pipe member 102A is excited by a longitudinal wave and an elastic wave (vibration) propagates to the pipe member 102A along the plane direction thereof. When this elastic wave propagates to the pipe member 102A, the elastic wave repeats mode exchanges of a longitudinal wave to a transverse wave and vice versa, so that the longitudinal wave and the transverse wave can be mingled therein. The transverse wave excites vibration in a horizontal direction of the pipe member 102A (i.e., a direction orthogonal to the plane of the pipe member 102A). This enables sound wave to radiate from the pipe member 102A to outside. In other words, an outer surface of the pipe member 102A can emit an acoustic output of high frequency range that corresponds to the high frequency range component SAH.

It is to be noted that, in this embodiment, the four magnetostrictive actuators 103 that are arranged in the base casing 101A at the same distance under and along a circular lower end surface of the pipe member 102A are driven on the basis of the same high frequency range component SAH of the monaural acoustic signal SA, so that a circumference of the pipe member 102A can emit an acoustic output of high frequency range with omni-directionality.

Further, the speaker unit 104A installed on the bottom surface of the base casing 101A is driven on the basis of the low frequency range component SAL of the monaural acoustic signal SA. The front of the speaker unit 104A emits an acoustic output of low frequency range (positive phase), so that this acoustic output can be emitted through the bottom surface of the base casing 101A to outside. The back of the speaker unit 104A emits an acoustic output of low frequency range (negative phase), so that this acoustic output can be emitted from the upper end of the pipe member 102A to outside through the opening 105 and an interior of the pipe member 102A.

According to the speaker 100A shown in FIGS. 2 through 5, the four magnetostrictive actuators 103 are driven on the basis of the high frequency range component SAH of the monaural acoustic signal SA so that the pipe member 102A as the acoustic diaphragm can emit acoustic output sound of high frequency range based on the high frequency range component SAH. In such the reproduction of high frequency range, any large amplitude (a large stroke) is not required, thereby enabling the pipe member 102A to emit the satisfied acoustic output sound of high frequency range. Further, according to the speaker 100A shown in FIGS. 2 through 5, the speaker unit 104A is driven on the basis of the low frequency range component SAL of the monaural acoustic signal SA so that the speaker unit 104A can emit acoustic output sound of low frequency range based on the low frequency range component SAL. In such the reproduction of low frequency range, the speaker unit 104A can get any large amplitude (a large stroke), thereby enabling the speaker unit 104A to emit the satisfied acoustic output sound of low frequency range. This enables the speaker to emit a satisfied acoustic output sound of high and low frequency ranges as a whole.

According to the speaker 100A shown in FIGS. 2 through 5, the magnetostrictive actuators 103 driven on the basis of the high frequency range component SAH of the monaural acoustic signal SA vibrate with the lower end surface of the pipe member 102A by a component of the vibration orthogonal to the lower end surface of the pipe member 102A (along a plane of the pipe member 102A). This prevents large transverse wave from occurring at a vibration point. Therefore, a listener does not listen to sound wave from the vibration point being sounded very loud, as compared by that from another position, so that an acoustic image can be created over a whole of the pipe member 102A in its longitudinal direction. This causes a global acoustic image to be obtained.

The following will describe simulations wherein a constant acceleration is input and an output is shown as the acceleration if the pipe member 102A vibrates at the lower end surface thereof in an axis direction thereof (case 1) and if the pipe member 102A vibrates at the lower end surface thereof in a radial direction thereof (case 2). In these simulations, it is supposed that the pipe member 102A, made of acrylic resin, having a length of 1000 mm, a diameter of 100 mm, and a thickness of 2 mm is used.

Figure 9:
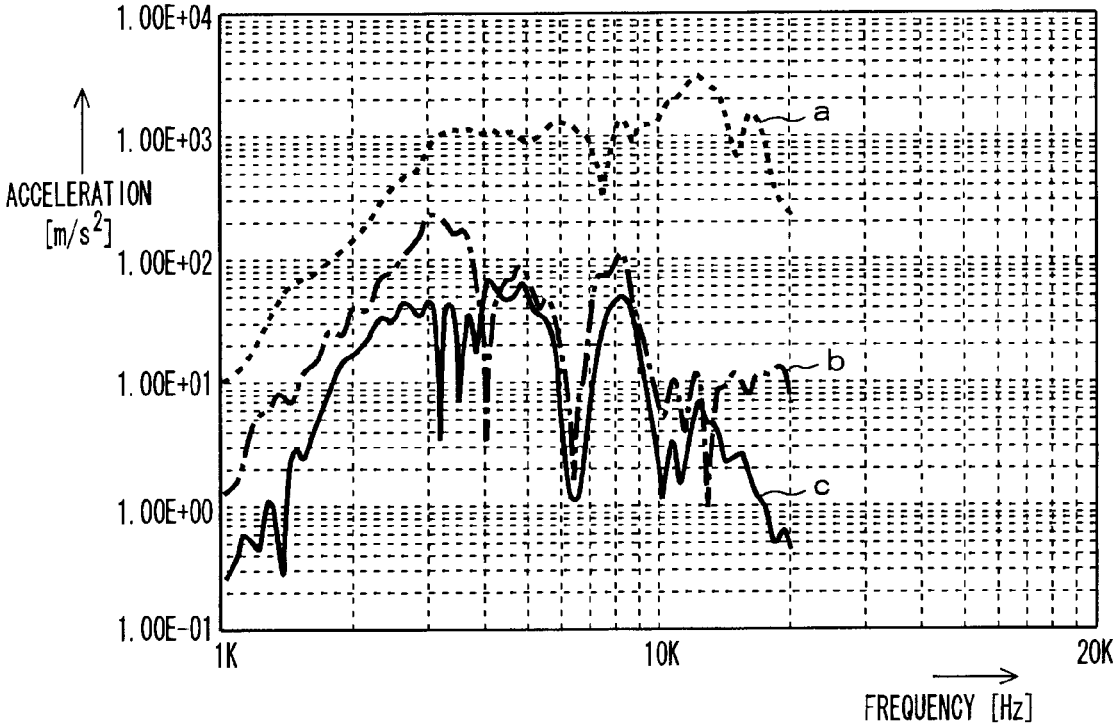
FIG. 9 is a graph for showing a result of a simulation of frequency response at each of the bottom position, the center position, and the top position of a pipe member when the pipe member vibrates in its radial direction.
Figure 10:
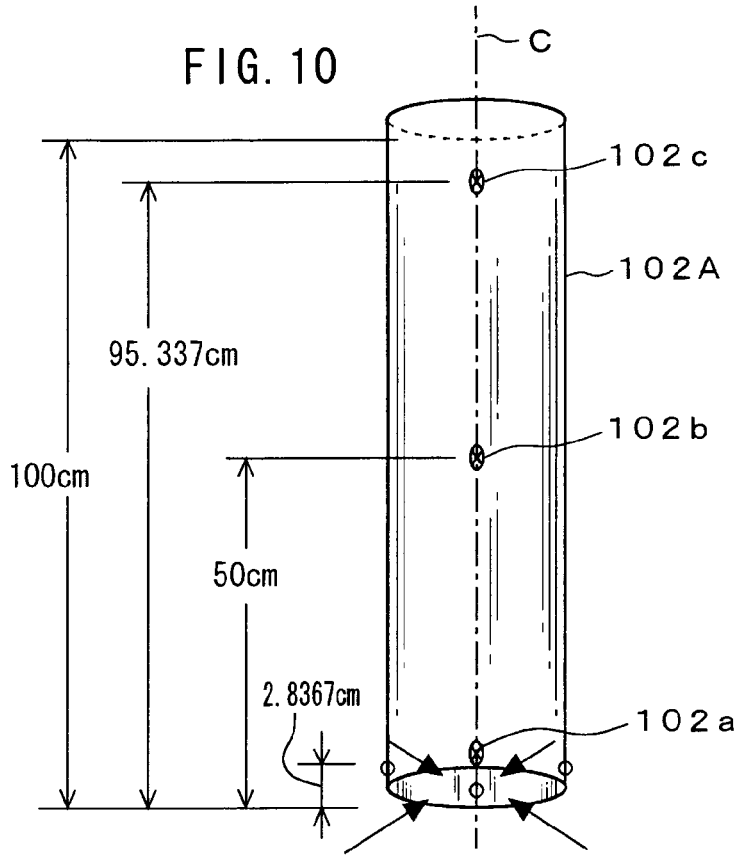
FIG. 10 is a diagram for illustrating a vibration direction when the pipe member vibrates in its radial direction.

FIG. 9 shows a result of the simulation when the pipe member 102A vibrates in its radial direction, as indicated by arrows of FIG. 10. A curve "a" indicates a frequency response at a bottom position 102*a* of the pipe member 102A that is positioned on a center axis C away from the lower end surface of the pipe member 102A by 2.8367 cm; a curve "b" indicates a frequency response at a center position 102*b* of the pipe member 102A that is positioned on the center axis C away from the lower end surface of the pipe member 102A by 50 cm; and a curve "c" indicates a frequency response at a top position 102*c* of the pipe member 102A that is positioned on the center axis C away from the lower end surface of the pipe member 102A by 95. 337 cm.

If the pipe member 102A vibrates in its radial direction, a large transverse wave occurs at a vibration point. Therefore, a listener can listen to sound wave from the vibration point being sounded very loud, as compared by that from another position, so that a difference between the accelerations (sound pressures) at the positions can be made relatively large, as shown in FIG. 9. This causes the listener to feel any uneven sound pressures at the positions of the pipe member 102A in its longitudinal direction. This prevents a global acoustic image from being obtained.

Figure 11:
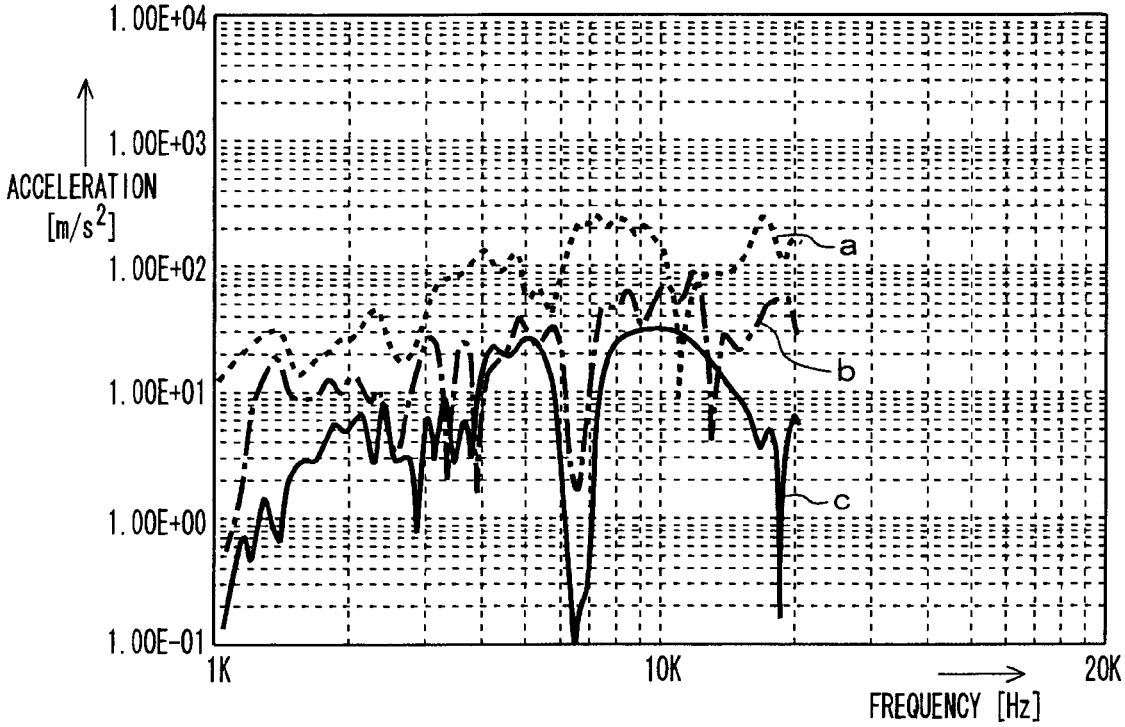
FIG. 11 is a graph for showing a result of a simulation of frequency response at each of the bottom position, the center position, and the top position of a pipe member when the pipe member vibrates in its axial direction.
Figure 12:
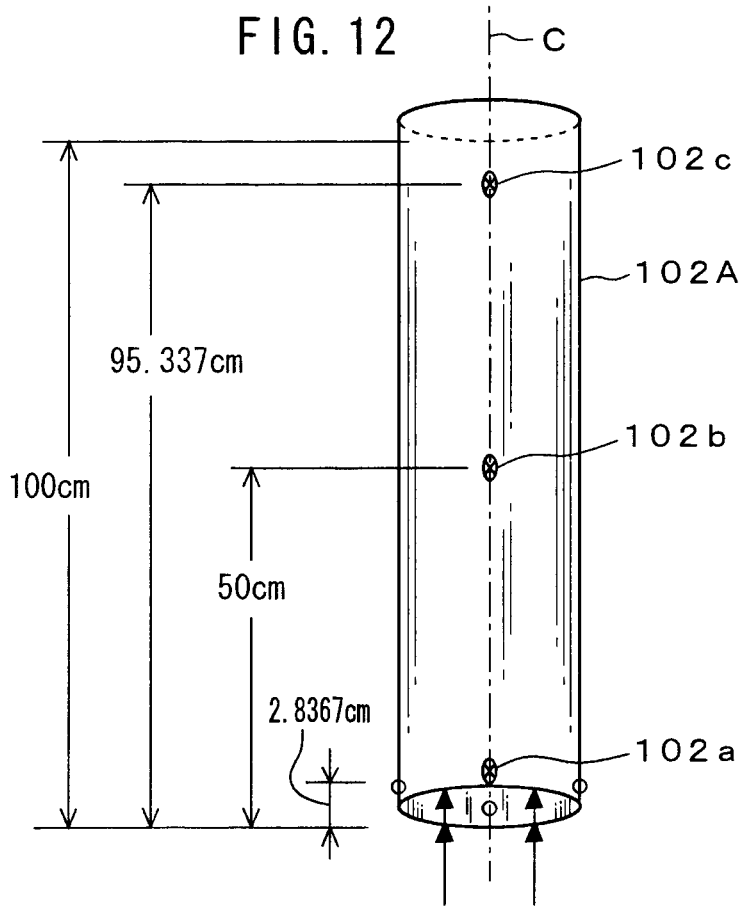
FIG. 12 is a diagram for illustrating a vibration direction when the pipe member vibrates in its axial direction.

FIG. 11 shows a result of the simulation when the pipe member 102A vibrates in its axis direction, as indicated by arrows of FIG. 12. A curve "a" indicates a frequency response at a bottom position 102*a* of the pipe member 102A that is positioned on a center axis C away from the lower end surface of the pipe member 102A by 2.8367 cm; a curve "b" indicates a frequency response at a center position 102*b* of the pipe member 102A that is positioned on the center axis C away from the lower end surface of the pipe member 102A by 50 cm; and a curve "c" indicates a frequency response at a top position 102*c* of the pipe member 102A that is positioned on the center axis C away from the lower end surface of the pipe member 102A by 95. 337 cm.

If the pipe member 102A vibrates in its axis direction (a direction orthogonal to the lower end surface of the pipe member 102A), no large transverse wave occurs at a vibration point. Therefore, a listener does not listen to sound wave from the vibration point being sounded very loud, as compared by that from another position, so that a difference between the accelerations (sound pressures) at the positions can be made relatively small, as shown in FIG. 11. This causes the listener to feel any even sound pressures at the positions of the pipe member 102A in its longitudinal direction. This allows a global acoustic image to be obtained.

According to the speaker 100A shown in FIGS. 2 through 5, the magnetostrictive actuators 103 vibrate with the lower end surface of the pipe member 102A, so that sound wave can radiate from the positions of the pipe member 102A in its longitudinal direction. This enables the acoustic output of high frequency range corresponding to the high frequency range component SAH of the monaural acoustic signal SA to be emitted from an outer surface of the pipe member 102A. Therefore, in this speaker 100A, any driving device such as the magnetostrictive actuator is not present at a position of the pipe member 102A wherein acoustic image is created, so that if the pipe member 102A is made of complete transparent material, no driving device is seen. Thus, it is possible to display any visual information relative to, for example, the emitted sound on the pipe member 102A without being interrupted with the driving device.

According to the speaker 100A shown in FIGS. 2 through 5, an acoustic output of low frequency range (positive phase) radiated from the front of the speaker unit 104A installed on the bottom of the base casing 101A can be emitted through the bottom surface of the base casing 101A to outside and the acoustic output of low frequency range (negative phase) emitted from the back of the speaker unit 104A can be emitted from the upper end of the pipe member 102A to outside through the opening 105 and an interior of the pipe member 102A. This enables the listener to feel any even sound pressures relative to the acoustic output of low frequency range at the positions of the pipe member 102A in its longitudinal direction, thereby creating the acoustic image over a whole of the pipe member 102A in its longitudinal direction, to obtain a global acoustic image.

Sound pressure levels (SPL) at a top position M1 and a bottom position M2, which are respectively away from each of the upper portion and the lower portion of the pipe member 102A by one meter, in the following measurements (1) and (2) were measured using microphones: The measurement (1) relates to a case where sound wave SW radiates from only the upper end of the pipe member 102A and the measurement (2) relates to a case where sound waves SW, SW radiate from both of the upper end and the bottom end of the pipe member 102A.

Figure 13:
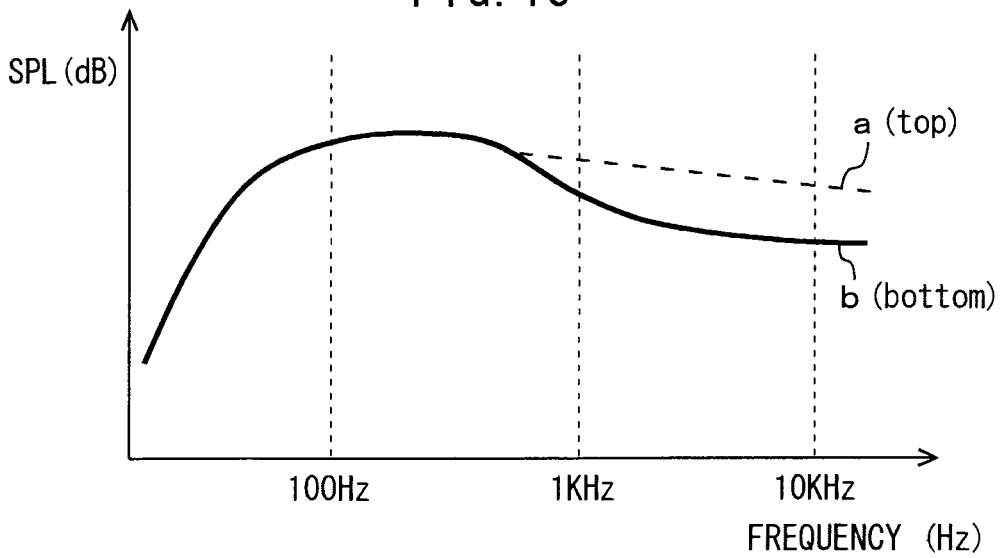
FIG. 13 is a graph for showing a result of a sound pressure level (SPL) measurement at each of the bottom position and the top position of a pipe member when sound wave is emitted from only the top of the pipe member.
Figure 14:
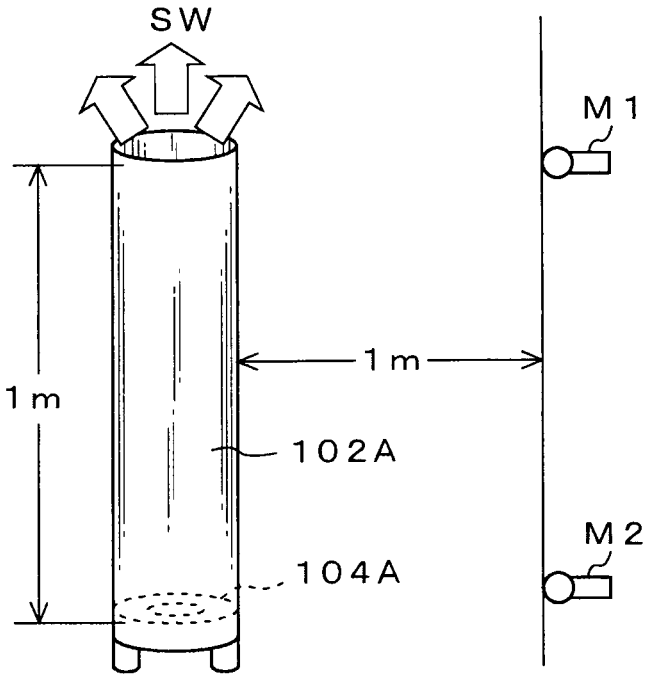
FIG. 14 is a diagram for illustrating an emission direction of the sound wave and positions to be measured when sound wave is emitted from only the top of the pipe member.

FIG. 13 shows a result of the measurement (1) when the sound wave SW radiates from only the upper end of the pipe member 102A, as indicated by arrows of FIG. 14. A curve "a" indicates SPL at the top position M1 and a curve "b" indicates SPL at the bottom position M2. As shown in FIG. 13, when the sound wave SW radiates from only the upper end of the pipe member 102A, SPL at the bottom position M2 is lower than that at the top position M1. This prevents the listener from feeling any even sound pressures relative to the acoustic output of low frequency range over a whole of the pipe member 102A in its longitudinal direction.

Figure 15:
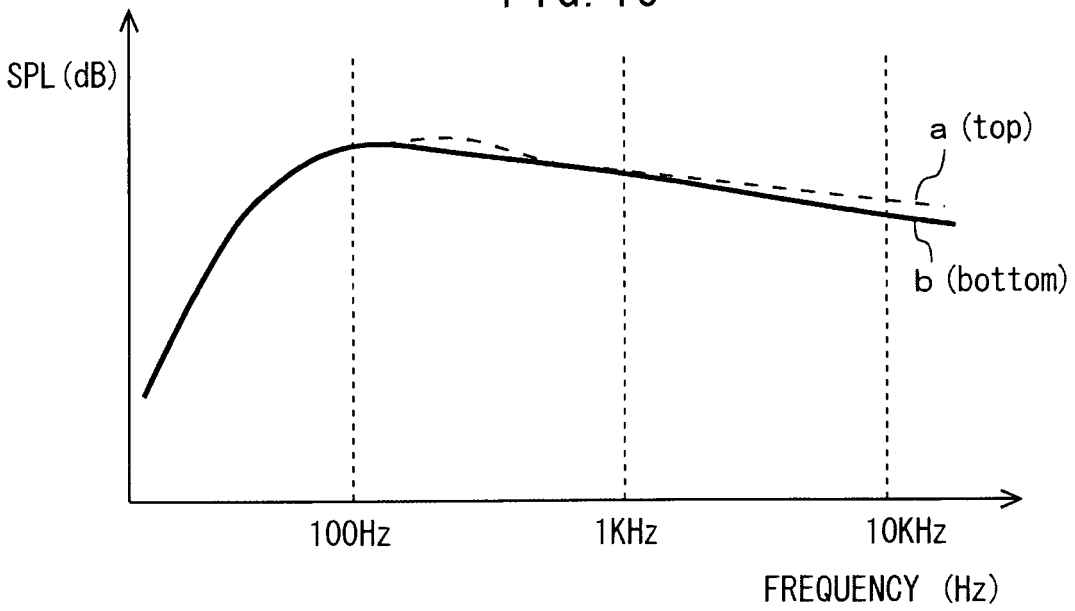
FIG. 15 is a graph for showing a result of the SPL measurement at each of the bottom position and the top position of a pipe member when sound wave is emitted from both of the top and the bottom of the pipe member.
Figure 16:
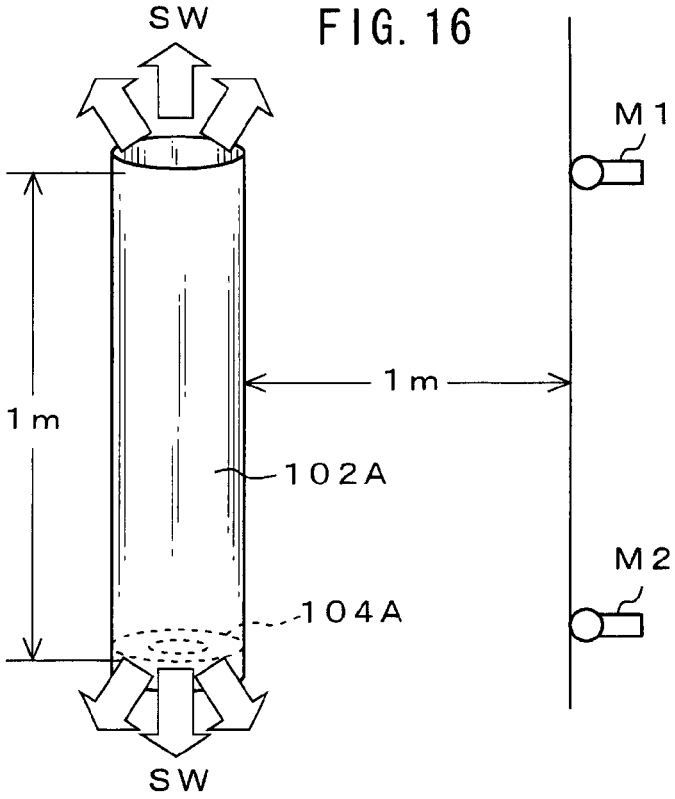
FIG. 16 is a diagram for illustrating an emission direction of the sound wave and positions to be measured when sound wave is emitted from both of the top and the bottom of the pipe member.

FIG. 15 shows a result of the measurement (2) when the sound waves SW, SW radiate from both of the upper end and the bottom end of the pipe member 102A, as indicated by arrows of FIG. 16. A curve "a" indicates SPL at the top position M1 and a curve "b" indicates SPL at the bottom position M2. As shown in FIG. 15, when the sound waves SW, SW radiates from both of the upper end and the bottom end of the pipe member 102A, SPL at the bottom position M2 is almost equal to that at the top position M1. This allows the listener to feel any even sound pressures relative to the acoustic output of low frequency range over a whole of the pipe member 102A in its longitudinal direction.

The driving system for the magnetostrictive actuators 103 and the speaker unit 104A has been described so that its configuration can be become that shown in FIG. 8 and the four magnetostrictive actuators 103 can be driven by the same high frequency range component SAH of the monaural acoustic signal SA. According to an embodiment, however, these four magnetostrictive actuators 103 can be driven by any separate high frequency range components SAH.

Figure 17:
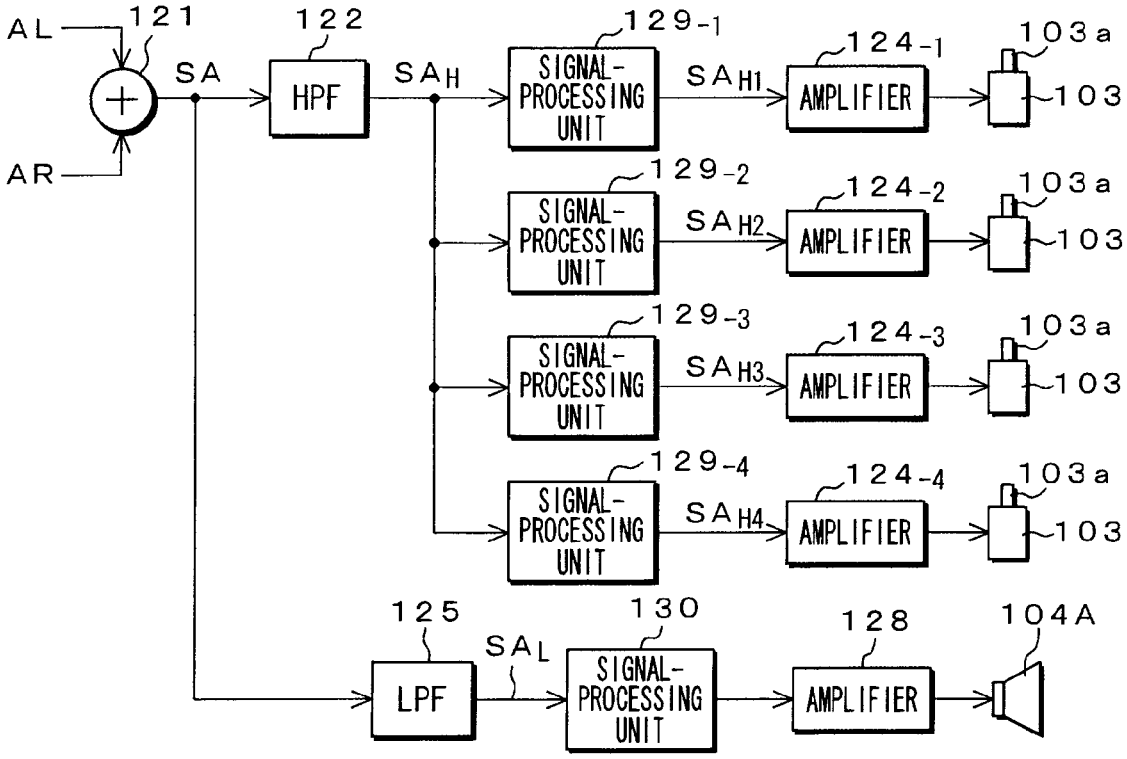
FIG. 17 is a block diagram for showing another configuration of a driving system for the magnetostrictive actuators and a speaker unit.

FIG. 17 shows another configuration of the driving system for the four magnetostrictive actuators 103 and the speaker unit 104A. In FIG. 17, like reference numbers refer to like elements of FIG. 8, a detailed explanation of which will be omitted.

The high frequency range component SAH of the monaural acoustic signal SA extracted by a high pass filter (HPF) 122 is supplied to four signal-processing units 129-1 through 129-4. These four signal-processing units 129-1 through 129-4 respectively adjust the high frequency range component SAH, separately, on its level, delay time, frequency characteristic and the like (i.e., perform any sound field control processing) and perform any signal compensation processing relative to output characteristics of the magnetostrictive actuator 103. Amplifiers 124-1 through 124-4 respectively receive the high frequency range components SAH1 through SAH4 from the four signal-processing units 129-1 through 129-4 and amplify them. Four magnetostrictive actuators 103 then receive the amplified high frequency range components SAH1 through SAH4, respectively, as the driving signals therefor. Thus, these four magnetostrictive actuators 103 are respectively driven on the basis of the separate high frequency range components SAH1 through SAH4, thereby enabling the driving rods 103*a* of these magnetostrictive actuators 103 to be separately displaced on the basis of the high frequency range components SAH1 through SAH4.

The low frequency range component SAL of the monaural acoustic signal SA extracted by a low pass filter (LPF) 125 is supplied to a signal-processing unit 130. The signal-processing unit 130 adjusts the low frequency range component SAL on its level, delay time, frequency characteristic and the like (i.e., performs any sound field control processing) and perform any signal compensation processing relative to resonance characteristics. An amplifier 128 receives the low frequency range component SAL from the signal-processing unit 130 and amplifies it. A speaker unit 104A then receives the amplified low frequency range component SAL as the driving signal therefor. Thus, the speaker unit 104A is driven on the basis of the low frequency range component SAL.

According to the configuration of the driving system shown in FIG. 17, these four magnetostrictive actuators 103 are respectively driven on the basis of the high frequency range components SAH1 through SAH4, which are separately obtained by processing in the signal-processing units 129-1 through 129-4, so that it is possible to enhance a global acoustic image.

It is to be noted that although, in the configuration of the driving system shown in FIG. 17, the high frequency range components SAH1 through SAH4 for driving the four magnetostrictive actuators 103 have been extracted from the monaural acoustic signal SA, this invention is not limited thereto. In an embodiment of the invention, they can be extracted from the left acoustic signal AL and the right acoustic signal AR, which constitute a stereo acoustic signal, or from a multichannel acoustic signal.

Figure 18:
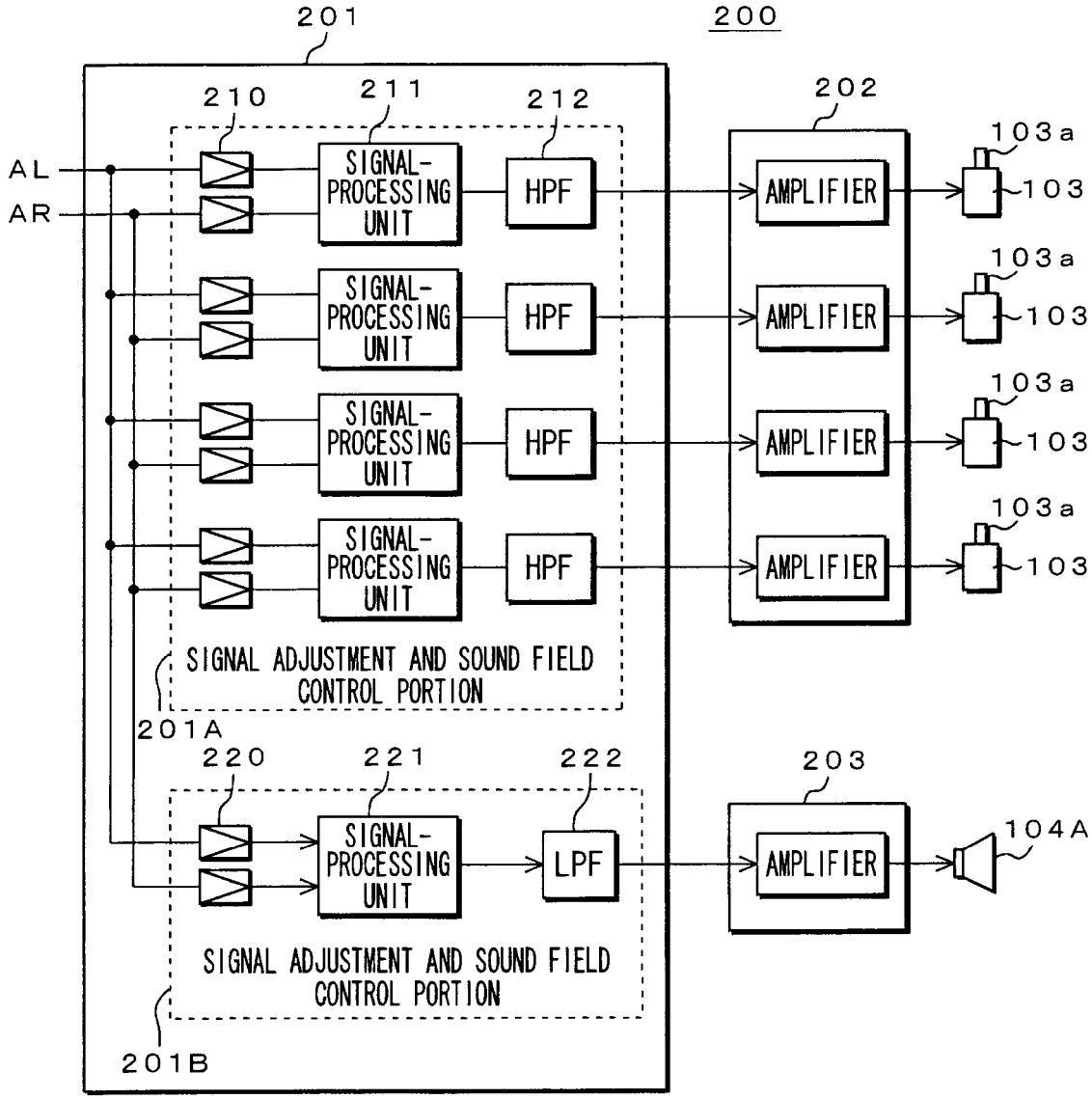
FIG. 18 is a block diagram for showing further configuration of a driving system for the magnetostrictive actuators and a speaker unit.

FIG. 18 shows further configuration of a driving system for the four magnetostrictive actuators 103 and the speaker unit 104A.

This driving system 200 has a digital signal processor (DSP) block 201, and amplification blocks 202 and 203. The DSP block 201 has a signal adjustment and sound field control sub-block 201A for the magnetostrictive actuators and a signal adjustment and sound field control sub-block 201B for the speaker unit.

The signal adjustment and sound field control sub-block 201A for the magnetostrictive actuators includes four signal-processing units 211 and four high pass filters (HPF) 212 which are respectively corresponded to the four magnetostrictive actuators 103. The signal adjustment and sound field compensation sub-block 201A also includes four pairs of (eight) attenuators 210 each pair for receiving and attenuating a left acoustic signal AL and a right acoustic signal AR that constitute a stereo acoustic signal to supply the attenuated signals for the four signal-processing units 211.

Each of the signal-processing units 211 receives and adjusts the acoustic signal AL and AR in their levels, delay times, and frequency properties and the like. Each of the signal-processing units 211 also performs any processing such as mixture of the acoustic signal AL and AR (sound field control processing). Each of the signal-processing units 211 further performs any signal compensation processing relative to output characteristics of the magnetostrictive actuator 103. Each of the HPFs 212 receives the acoustic signal from the corresponding signal-processing unit 211 and extracts high frequency components therefrom to supply them to the amplification block 202.

The amplification block 202 receives and amplifies the high frequency components of the acoustic signals on which the signal adjustment and sound field compensation sub-block 201A of the DSP block 201 has separately performed the sound control processing and the signal compensation processing to supply the magnetostrictive actuators 103 with them. The magnetostrictive actuators 103 then receive the amplified high frequency components of the acoustic signals, respectively, and are driven based on them. Thus, driving the four magnetostrictive actuators 103 based on the high frequency components on which the sound control processing have been performed allows a global acoustic image to be enhanced by high frequency acoustic output.

On the other hand, the signal adjustment and sound field control sub-block 201B for speaker unit includes one signal-processing unit 221 and one low pass filter (LPF) 222 which are respectively corresponded to the speaker unit 104A. The signal adjustment and sound field compensation sub-block 201B also includes a pair of (two) attenuators 220 for receiving and attenuating the left acoustic signal AL and the right acoustic signal AR that constitute the stereo acoustic signal to supply the attenuated signals to the signal-processing unit 221.

The signal-processing unit 221 receives and adjusts the acoustic signals AL and AR in their levels, delay times, and frequency properties and the like. The signal-processing unit 221 also performs any processing such as mixture of the acoustic signals AL and AR (sound field control processing). The signal-processing unit 221 further performs any signal compensation processing relative to resonator characteristics. The LPF 222 receives the acoustic signal from the signal-processing unit 221 and extracts low frequency components therefrom to supply it to the amplification block 203.

The amplification block 203 receives and amplifies the low frequency components of the acoustic signal on which the signal adjustment and sound field compensation sub-block 201B of the DSP block 201 has performed the sound control processing and the signal compensation processing to supply the speaker unit 104A with them. The four speaker unit 104A then receives the amplified low frequency components of the acoustic signal and is driven based on them. Thus, driving the speaker unit 104A based on the low frequency components on which the sound control processing has been performed allows a global acoustic image to be enhanced by low frequency acoustic output.

It is to be noted that in the driving system 200 as shown in FIG. 18, the signal-processing units 211 and the HPFs 212 can be arranged along a contrary order in the signal adjustment and sound field compensation sub-block 201A and similarly, the signal-processing unit 221 and the LPF 222 can be arranged along a contrary order in the signal adjustment and sound field compensation sub-block 201B.

Figure 19:
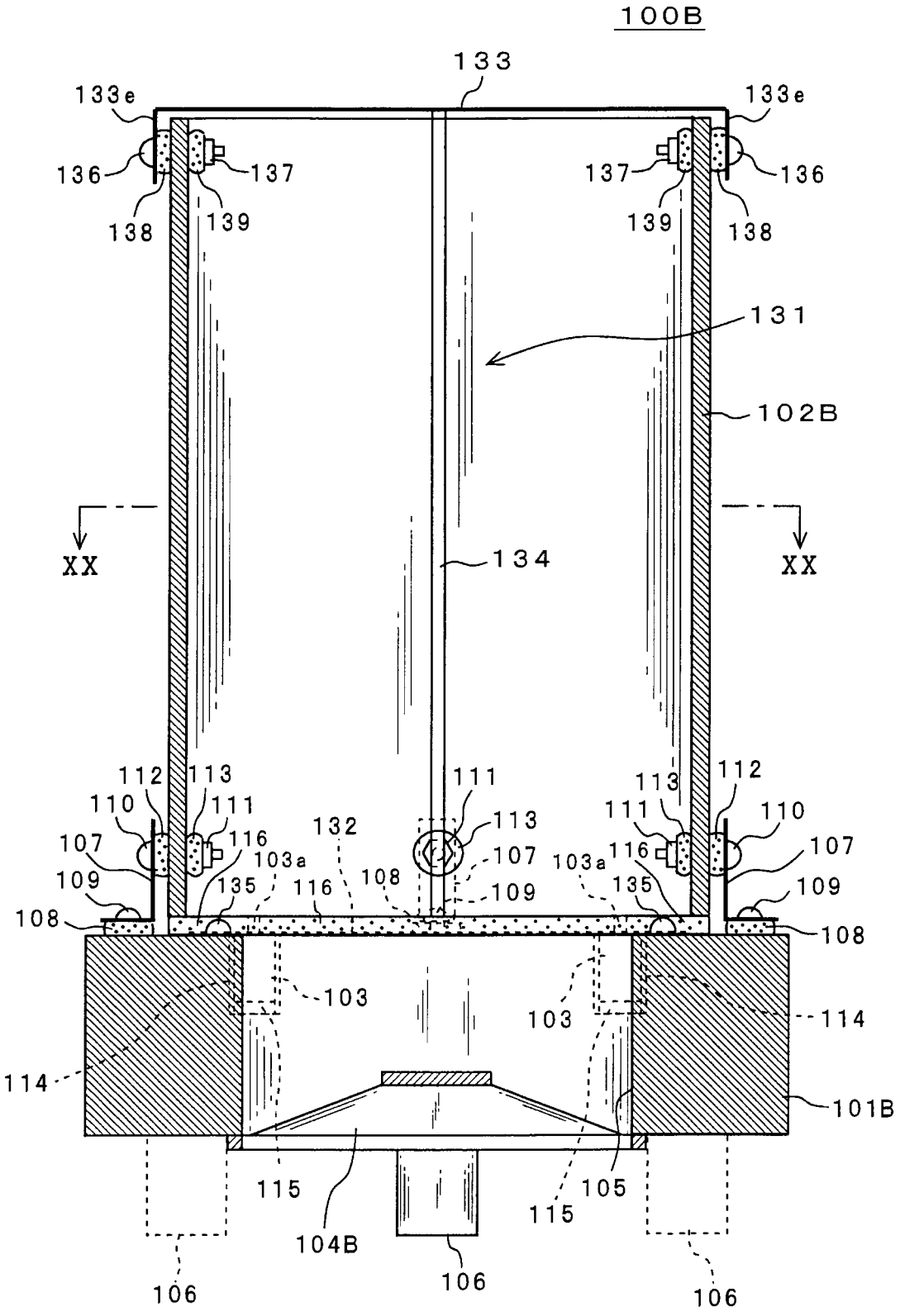
FIG. 19 is a vertical sectional view of a speaker 100B according to a second embodiment of the invention.
Figure 20:
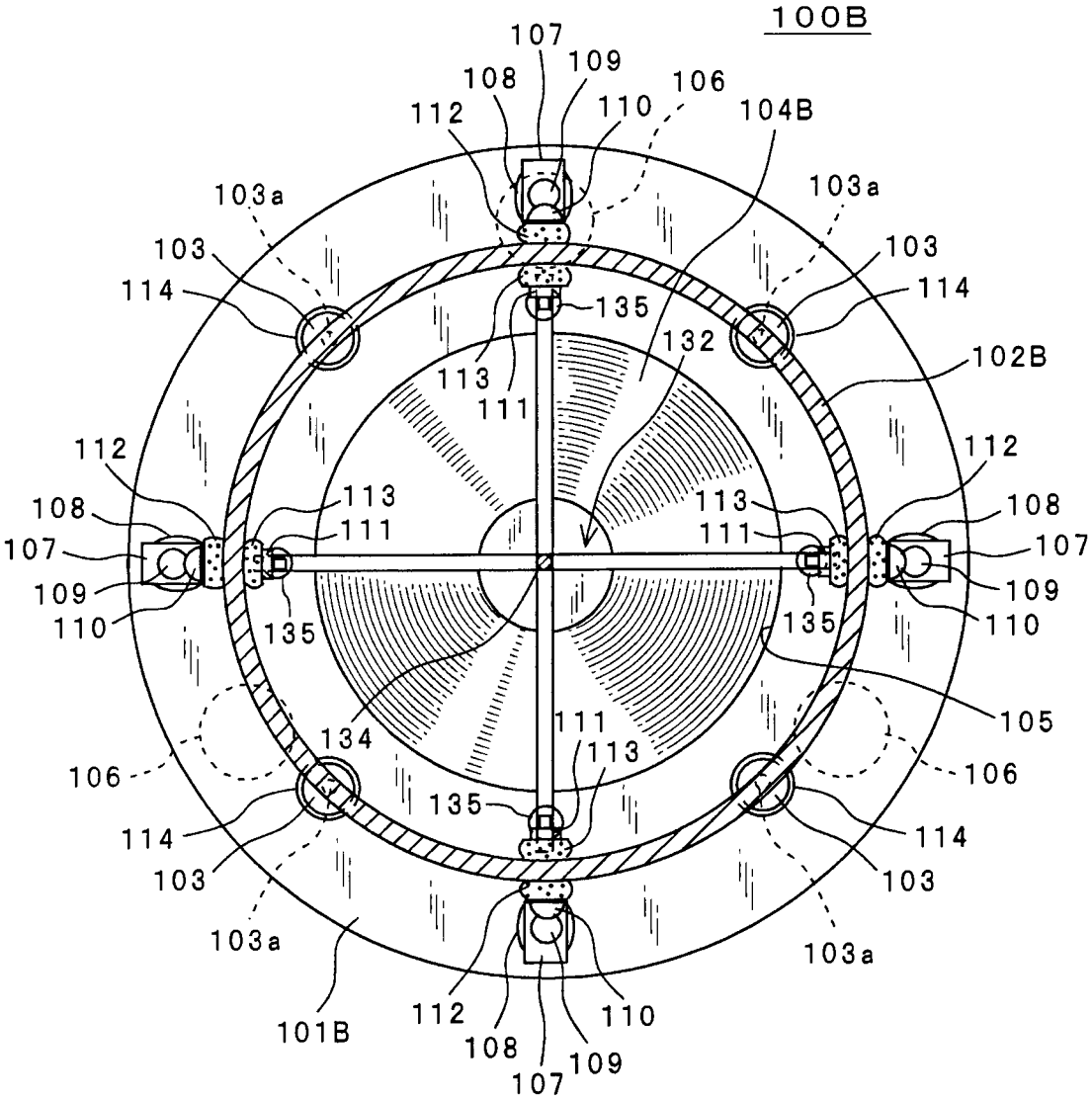
FIG. 20 is a traverse sectional view of the speaker 100B according to the second embodiment of the invention.
Figure 21:
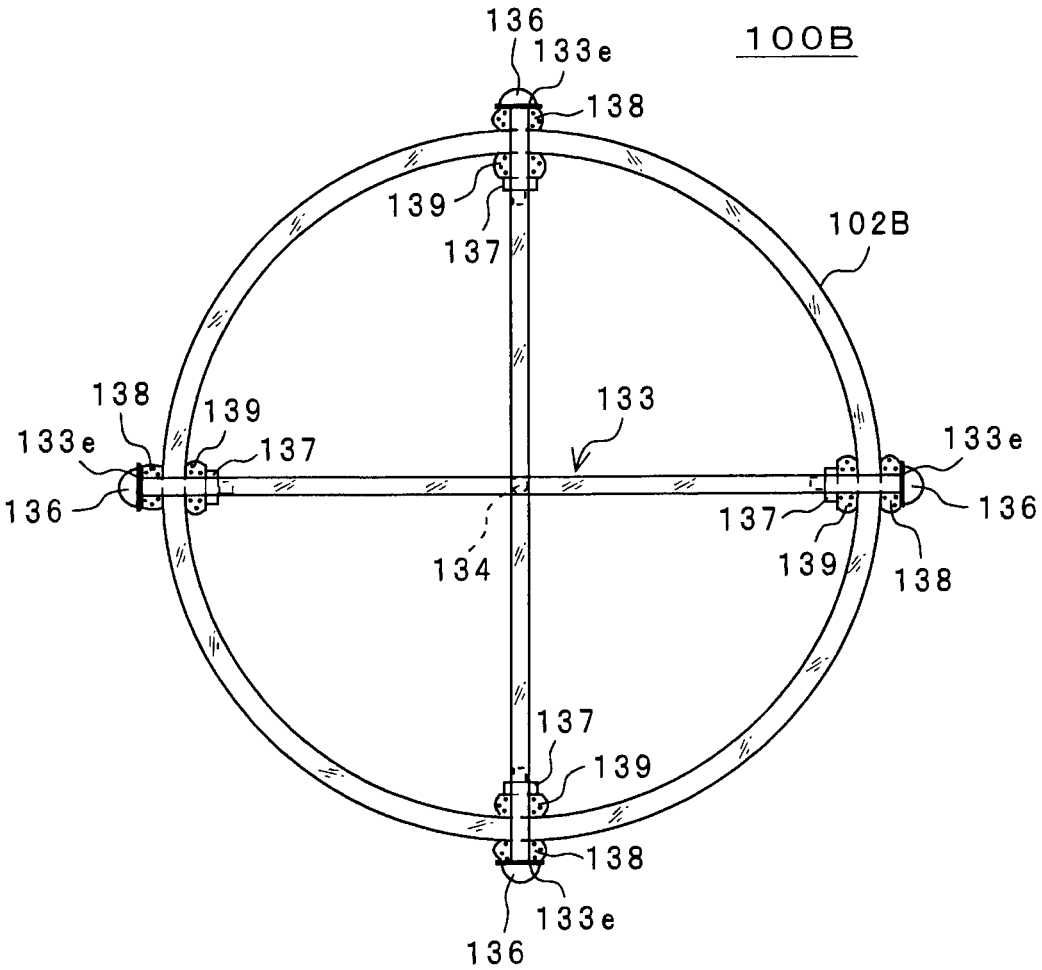
FIG. 21 is a partially omitted top plan view of the speaker 100B according to the second embodiment of the invention.

The following will describe a speaker 100B according to a second embodiment of the invention. FIGS. 19 through 21 show a configuration of the speaker 100B according to the second embodiment of the invention. FIG. 19 shows a vertical sectional view of the speaker 100B; FIG. 20 is a traverse sectional view of the speaker 100B, a lower portion of which is clearly shown taken along the lines XX-XX shown in FIG. 19; and FIG. 21 is a top plan view of the speaker 100B (a lower portion of which is shown taken along the lines XX-XX shown in FIG. 19 will be omitted). In FIGS. 19 through 21, like reference numbers refer to like elements of FIGS. 2 through 5, a detailed explanation of which will be omitted.

The speaker 100B has a supporting member 131 that supports a pipe member 102B, in addition to the configuration of the speaker 100A shown in FIGS. 2 through 5. The supporting member 131 has lower crossed bars 132 to be set on the top surface of a base casing 101B, upper crossed bars 133 to be set on the top of the pipe member 102B, and a rod 134. An end of the rod 134 is connected to a center of the lower crossed bars 132 and the other end thereof is connected to a center of the upper crossed bars 133.

Four ends of the lower crossed bars 132 respectively have round holes for screws, not shown. The four ends thereof are respectively secured to the top surface of the base casing 101B by screws 135. Each screw hole, not shown, to which a screw thread of each of the screws 135 is secured is formed in the base casing 101B.

Four ends 133*e* of the upper crossed bars 133 are respectively made wide and fold down at right angles. These four ends 133*e* respectively have round holes for screws, not shown. The four ends 133*e* of the upper crossed bars 133 are respectively secured to the top portion of the pipe member 102B by screws 136 and nuts 137. Each screw hole, not shown, to which a screw thread of the screw 136 is secured is formed in the top portion of the pipe member 102B.

Damper members 138, 139 each constituted of ring-shaped rubber member or the like stand between each of the four ends 133*e* of the upper crossed bars 133 and the outer surface of the pipe member 102B and between each of the nuts 137 and the inner surface of the pipe member 102B. This prevents the vibration (elastic wave) by the magnetostrictive actuators 103 from propagating to the base casing 101B through the pipe member 102B and the supporting member 131.

Remaining parts of the speaker 100B shown in FIGS. 19 through 21 are similar to those of the speaker 100A shown in FIGS. 2 through 5. The speaker 100B shown in FIGS. 19 through 21 operates similar to the operations of the speaker 100A shown in FIGS. 2 through 5.

According to the speaker 100B, it can attain any satisfied effects similar to those of the speaker 100A as well as since the supporting member 131 supports the pipe member 102B, it can secure its equilibrium if the pipe member 102B is elongated. The supporting member 131 includes the rod 134 and the like as described above so that their occupied capacity in the pipe member 102B is made small, which has little influence on any function of the pipe member 102B as a resonator.

Figure 22:
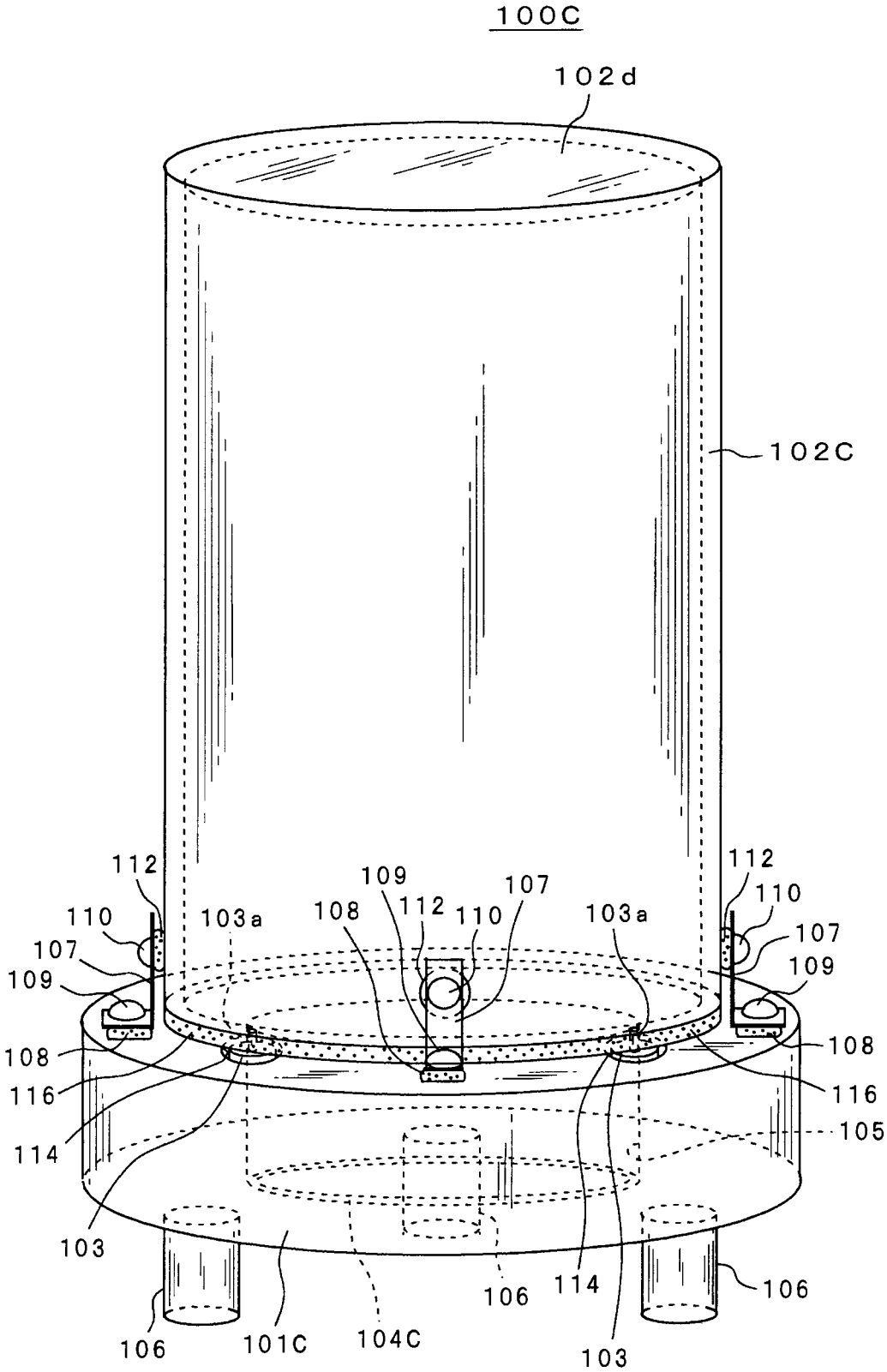
FIG. 22 is a perspective view of a speaker 100C according to a third embodiment of the invention.

The following will describe a speaker 100C according to a third embodiment of the invention. FIG. 22 shows a configuration of the speaker 100C according to the third embodiment of the invention. FIG. 22 shows a perspective view of the speaker 100C. In FIG. 22, like reference numbers refer to like elements of FIG. 2, a detailed explanation of which will be omitted.

In this speaker 100C, a cup member 102C that is a pipe member having a bottom is used in place of the pipe member 102A of the speaker 100A shown in FIG. 2. This cup member 102C is set upside down on the top surface of the base casing 101C with an upper portion thereof being closed by a bottom 102*d* and a lower portion thereof being opened. How to set this cup member 102C is similar to that of the pipe member 102A, a detailed explanation of which will be omitted.

The driving rods 103*a* of the magnetostrictive actuators 103 set in the base casing 101C are respectively attached to a lower end surface of the cup member 102C. This enables the cup member 102C to vibrate by the magnetostrictive actuators 103, similar to the above-mentioned pipe member 102A, by their component of vibration orthogonal to the lower end surface of the cup member 102C from the lower end surface thereof.

It is to be noted that in this speaker 100C, a damper member 116 as the speaker 100A shown in FIG. 2 stands between the lower end surface of the cup member 102C and the base casing 101C. This is because the cup member 102C has no function as a resonator for the reason that the upper portion thereof is closed by the bottom 102*d* but it may be necessary to enhance its sealing in order to act as an air chamber in an ordinary speaker cabinet (a back cavity). Since the pipe member 102C acts as the back cavity of the speaker unit 104C, it is possible to improve any response property in middle frequency range in the speaker 100C.

Remaining parts of the speaker 100C shown in FIG. 22 is similar to those of the speaker 100A shown in FIG. 2. The speaker 100C shown in FIG. 22 operates similar to the operations of the speaker 100A shown in FIG. 2 except if the cup member 102C has no function as the resonator.

According to the speaker 100C, the magnetostrictive actuators 103 driven based on the high frequency range component SAH of the monaural acoustic signal SA vibrate with the lower end surface of the cup member 102C by their component of vibration orthogonal to the lower end surface of the cup member 102C. This prevents large transverse wave from occurring at a vibration point. Therefore, a listener does not listen to sound wave from the vibration point being sounded very loud, as compared by that from another position, so that an acoustic image can be created over a whole of the cup member 102C in its longitudinal direction. This causes a global acoustic image to be obtained.

Since, according to the speaker 100C, the upper portion of the pipe member is closed by the bottom 102*d* to form the cup member 102C, any vibration (elastic wave) by the magnetostrictive actuators 103 can propagate up to this bottom 102*d* so that the bottom 102*d* can also emit sound wave to outside, thereby enhancing the global acoustic image.

Figure 23:
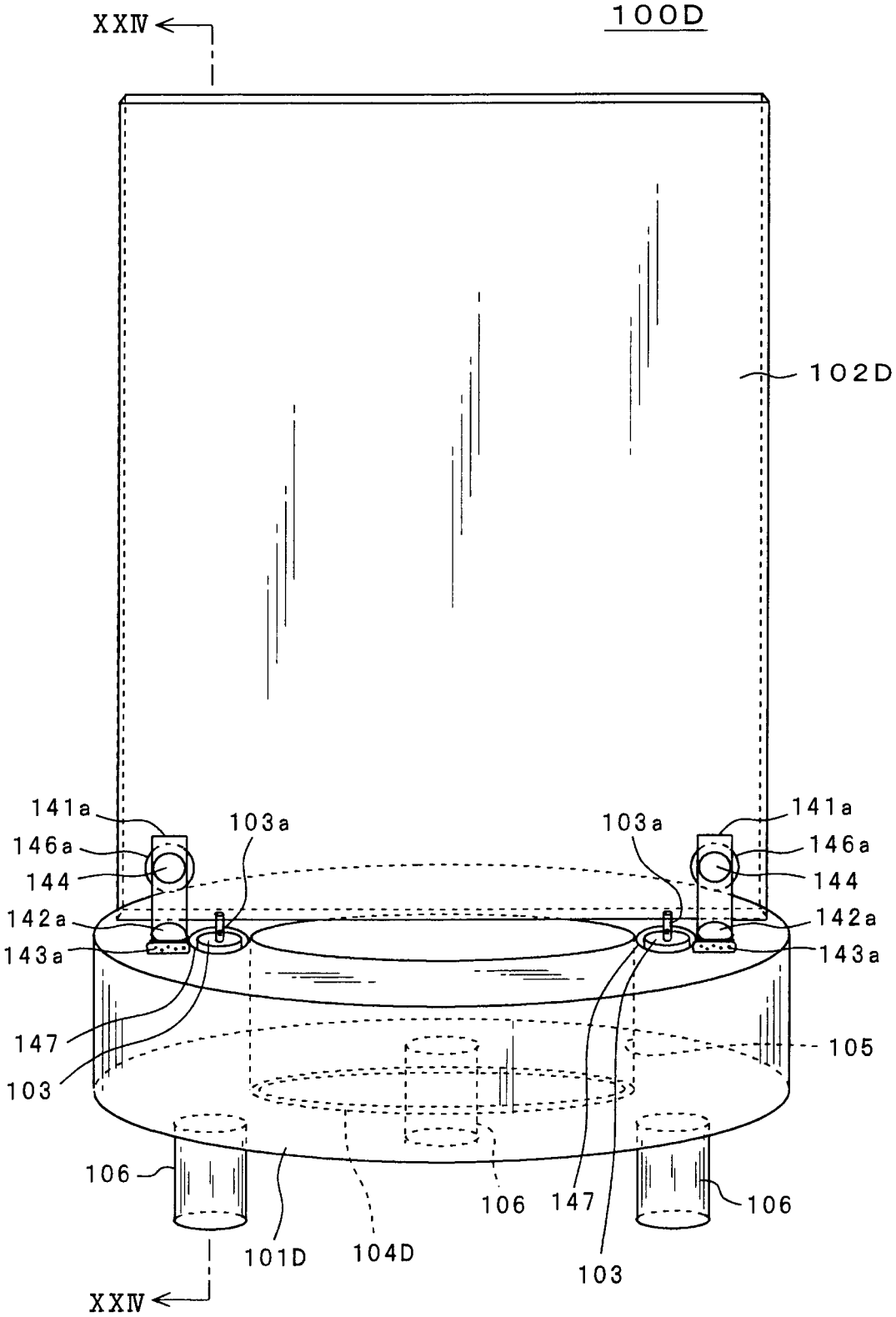
FIG. 23 is a perspective view of a speaker 100D according to a fourth embodiment of the invention.
Figure 24:
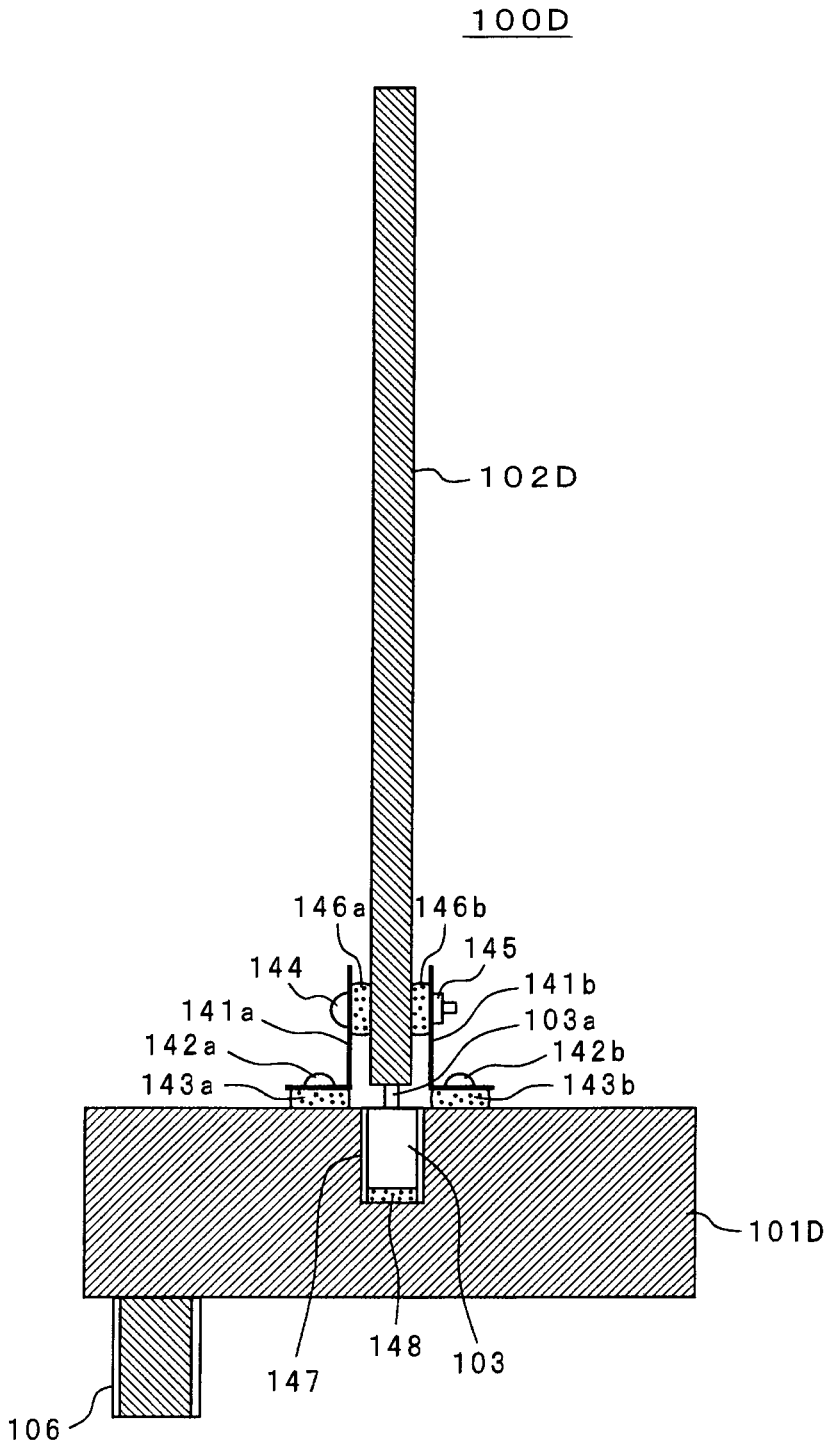
FIG. 24 is a vertical sectional view of the speaker 100D according to the fourth embodiment of the invention.

The following will describe a speaker 100D according to a fourth embodiment of the invention. FIGS. 23 and 24 show a configuration of the speaker 100D according to the fourth embodiment of the invention. FIG. 23 is a perspective view of the speaker 100D and FIG. 23 is a vertical sectional view of the speaker 100D taken along the lines XXIV-XXIV shown in FIG. 23. In FIGS. 23 and 24, like reference numbers refer to like elements of FIGS. 2 and 3, a detailed explanation of which will be omitted.

Although the pipe member 102A has been used as the acoustic diaphragm with a tube shape in the speaker 100A shown in FIGS. 2 and 3, a rectangular acrylic plate 102D is used as the acoustic diaphragm with a plate shape in the speaker 100D according to this embodiment of the invention.

This acrylic plate 102D is set on abase casing 101D. Namely, a lower end portion of the acrylic plate 102D is set on a top surface of the base casing 101D at a plurality of positions, in this embodiment, two positions by using two L-shaped metal angles 141*a*, and 141*b* at each position.

In both ends of each of the L-shaped metal angles 141*a*, 141*b*, round holes for a screw, not shown, are respectively bored. An end of each of the L-shaped angles 141*a*, 141*b* is screwed to the top surface of the base casing 101D by a screw 142*a* or 142*b*. Each screw hole, not shown, to which a screw thread of each of the screws 142*a*, 142*b* is secured is formed in the base casing 101D. The ends of the L-shaped angles 141*a*, 141*b* are respectively screwed to the top surface of the base casing 101D through damper members 143*a*, 143*b* each constituted of ring-shaped rubber member or the like.

The other ends of the L-shaped angles 141*a*, 141*b* are secured to a lower end portion of the acrylic plate 102D by screws 144 and nuts 145. Each screw hole, not shown, to which a screw thread of each of the screws 144 is secured is formed in the lower end portion of the acrylic plate 102D. It is to be noted that the L-shaped angles 141*a* are positioned at one side of the acrylic plate 102D while the L-shaped angles 141*b* are positioned at the other side of the acrylic plate 102D. Damper members 146*a*, 146*b* each constituted of ring-shaped rubber member or the like stand between the other end of the L-shaped angle 141*a* and a side surface of the acrylic plate 102D and between the other end of the L-shaped angle 141*b* and the other side surface of the acrylic plate 102D.

The damper members 143*a*, 143*b*, 146*a*, and 146*b* thus intervened prevent any vibration (elastic wave) by magnetostrictive actuators 103 from propagating to the base casing 101D thorough the acrylic plate 102D and the L-shaped angles 141*a*, 141*b*, thereby avoiding localizing an acoustic image to the base casing 101D.

The plural magnetostrictive actuators 103, in this embodiment, two magnetostrictive actuators are set in the base casing 101D. These two magnetostrictive actuators 103 are positioned under and along a lower end surface of the acrylic plate 102D. In the base casing 101D, hollows 147 each for containing the magnetostrictive actuator 103 are formed. The magnetostrictive actuators 103 are respectively set on the base casing 101D with them being contained in the hollows 147.

Each of the magnetostrictive actuators 103 is set on a bottom surface of the hollow 147 in the base casing 101D through a damper member 148 constituted of rubber member or the like. The damper member 148 thus intervened prevents any vibrations by the magnetostrictive actuators 103 from propagating to the base casing 101D, thereby avoiding localizing an acoustic image to the base casing 101D.

When each of the magnetostrictive actuators 103 is set on the base casing 101D with them being contained in the hollows 147 thereof, the driving rod 103*a* of each of the magnetostrictive actuators 103 is attached to the lower end surface of the acrylic plate 102D. In this moment, a displacement direction of each of the driving rods 103*a* is oriented along a direction orthogonal to the lower end surface of the acrylic plate 102D, namely, a direction along a plane of the acrylic plate 102D. Such a configuration enables the magnetostrictive actuators 103 to vibrate with the lower end surface of the acrylic plate 102D by their component of the vibration that is orthogonal to the lower end surface of the acrylic plate 102D.

The two magnetostrictive actuators 103 are driven by the driving system, for example, one shown in FIG. 8 based on the same high frequency range component SAH, so that their driving rods 103*a* can displace corresponding to the high frequency range component SAH. Alternatively, these two magnetostrictive actuators 103 are respectively driven by the driving system, for example, one shown in FIG. 17 or 18 based on the separate high frequency range components SAH1, SAH2, so that their driving rods 103*a* can displace corresponding to their corresponding high frequency range components SAH1, SAH2, respectively.

In this speaker 100D, the rectangular acrylic plate 102D is used as the acoustic diaphragm with a plate shape and thus, the rectangular acrylic plate 102D is not used as a resonator. Accordingly, the opening 105 of the case casing 101D is closed at its upper end. This enables a closed space to be formed on a back side of the speaker unit 104, thereby allowing any low frequency sound to be enhanced.

The following will describe operations of the speaker 100D shown in FIGS. 23 and 24.

The two magnetostrictive actuators 103 contained in and set on the base casing 101 are driven by, for example, the high frequency range component SAH of the monaural acoustic signal SA. Their driving rods 103*a* displace corresponding to the high frequency range component SAH. Based on the displacement of each of the driving rods 103*a*, the magnetostrictive actuators 103 vibrate with the lower end surface of the acrylic plate 102D by their component of the vibration orthogonal to the lower end surface of the acrylic plate 102D.

The lower end surface of the acrylic plate 102D is excited by a longitudinal wave. An elastic wave (vibration) propagates to the plane direction of the acrylic plate 102D. When this elastic wave propagates to the acrylic plate 102D, the elastic wave repeats mode exchanges of a longitudinal wave to a transverse wave and vice versa, so that the longitudinal wave and the transverse wave can be mingled therein. The transverse wave excites vibration in a horizontal direction of the acrylic plate 102D (i.e., a direction orthogonal to the plane of the acrylic plate 102D). This enables sound wave to be emitted from both side surfaces of the acrylic plate 102D. In other words, outer surfaces of the acrylic plate 102D can emit an acoustic output of high frequency range that corresponds to the high frequency range component SAH.

The speaker unit 104D installed on the bottom of the base casing 101D is driven based on the low frequency range component SAL of the monaural acoustic signal SA. The front of the speaker unit 104D emits an acoustic output of low frequency range (positive phase), so that this acoustic output can be emitted from the bottom of the base casing 101D to outside.

According to the speaker 100D shown in FIGS. 23 and 24, similar to the speaker 100A as shown in FIG. 2, the two magnetostrictive actuators 103 are driven based on the high frequency range component SAH so that the acrylic plate 102D as the acoustic diaphragm can emit acoustic output sound of high frequency range based on the high frequency range component SAH. The speaker unit 104D is driven based on the low frequency range component SAL so that the speaker unit 104D can emit acoustic output sound of low frequency range based on the low frequency range component SAH. This allows the speaker 100D to emit any satisfied acoustic output sounds.

According to the speaker 100D shown in FIGS. 23 and 24, similar to the speaker 100A shown in FIG. 2, the magnetostrictive actuators 103 driven based on the high frequency range component SAH of the monaural acoustic signal SA vibrate with the lower end surface of the acrylic plate 102D by their component of vibration orthogonal to the low end surface of the acrylic plate 102D. This prevents large transverse wave from occurring at a vibration point. Therefore, a listener does not listen to sound wave from the vibration point being sounded very loud, as compared by that from another position, so that an acoustic image can be created over whole surfaces of the acrylic plate 102D. This causes a global acoustic image to be obtained.

According to the speaker 100D shown in FIGS. 23 and 24, the magnetostrictive actuators 103 vibrate with the lower end surface of the acrylic plate 102D, so that sound wave can be emitted from each position of the acrylic plate 102D in its longitudinal direction. This enables acoustic output of high frequency range corresponding to the high frequency range component SAH of the monaural acoustic signal SA to be emitted from the outer surfaces of the acrylic plate 102D. Accordingly, in this speaker 100D, any driving device such as the magnetostrictive actuator is not present at a position of the acrylic plate 102D wherein acoustic image is created, so that if the acrylic plate 102D is made of complete transparent material, no driving device is seen. Thus, it is possible to display any visual information, for example, to the accompaniment of emitted sound on the acrylic plate 102D without being interrupted with the driving device.

Figure 25:
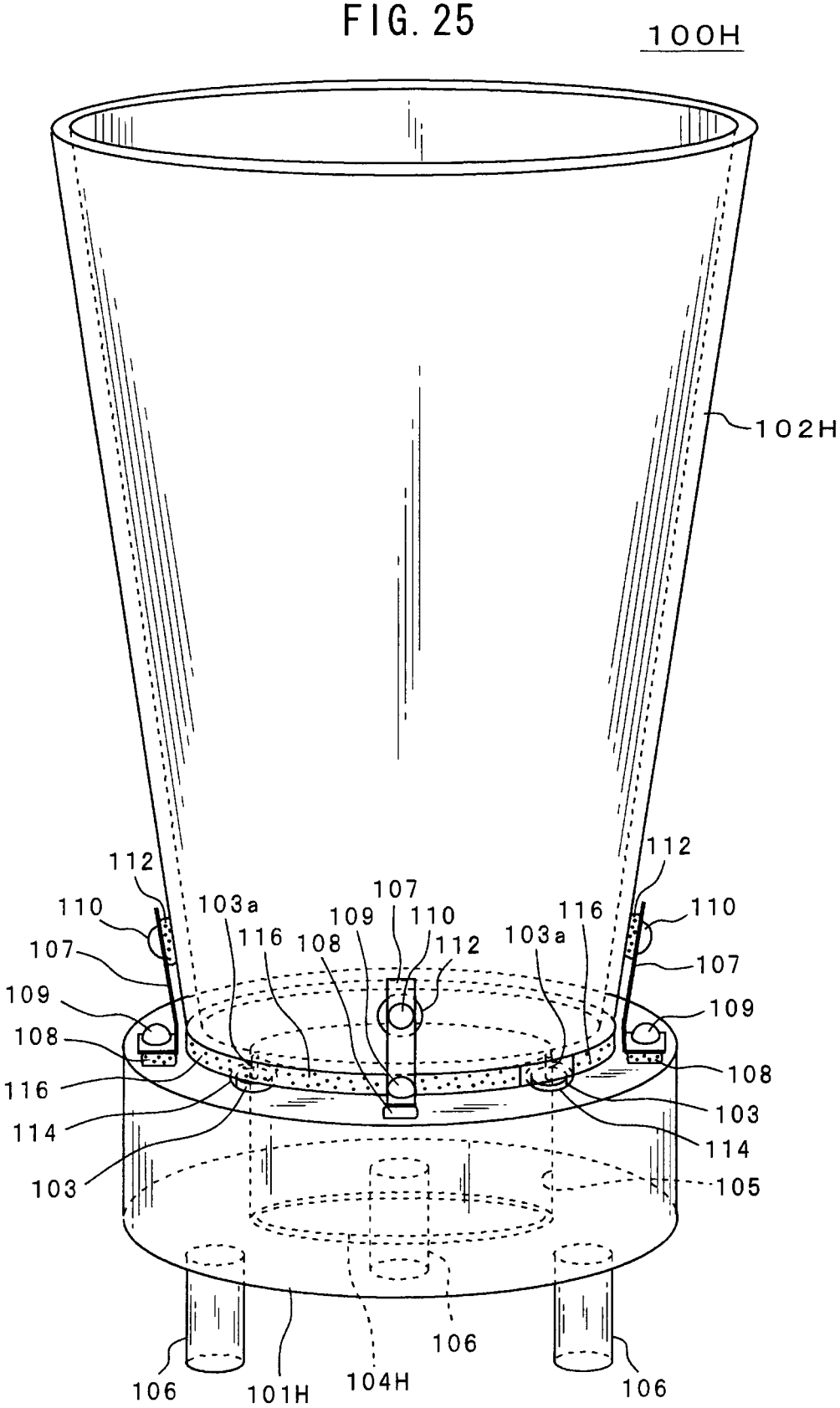
FIG. 25 is a perspective view of a speaker 100H according to a fifth embodiment of the invention.

The following will describe a speaker 100H according to a fifth embodiment of the invention. FIG. 25 shows a configuration of the speaker 100H according to the fifth embodiment of the invention. FIG. 25 is a perspective view of the speaker 100H. In FIG. 25, like reference numbers refer to like elements of FIG. 2, a detailed explanation of which will be omitted.

In this speaker 100H, a pipe member 102H is used in place of the pipe member 102A of the speaker 100A shown in FIG. 2. The pipe member 102H has different diameters of its circular cross sections, which are gradually made larger toward a direction (upwardly in FIG. 25) where the sound wave radiated from the speaker unit 104H propagates.

Remaining parts of the speaker 100H shown in FIG. 25 are similar to those of the speaker 100A shown in FIG. 2. The speaker 100H shown in FIG. 25 operates similar to the operations of the speaker 100A shown in FIG. 2.

According to the speaker 100H, in addition to a satisfied effect similar to that of the above speaker 100A, the following effect can be attained. Namely, since the pipe member 102H has different diameters of its circular cross sections, which are gradually made larger toward a direction wherein the sound wave radiated from the speaker unit 104 propagates, it can have any increased electric inductance components, thereby enabling flat frequency properties and resonance dumping effects to be gotten. Since the pipe member 102H has an enlarged opening from which the sound wave radiates, it is possible to enhance a global acoustic image.

Figure 26:
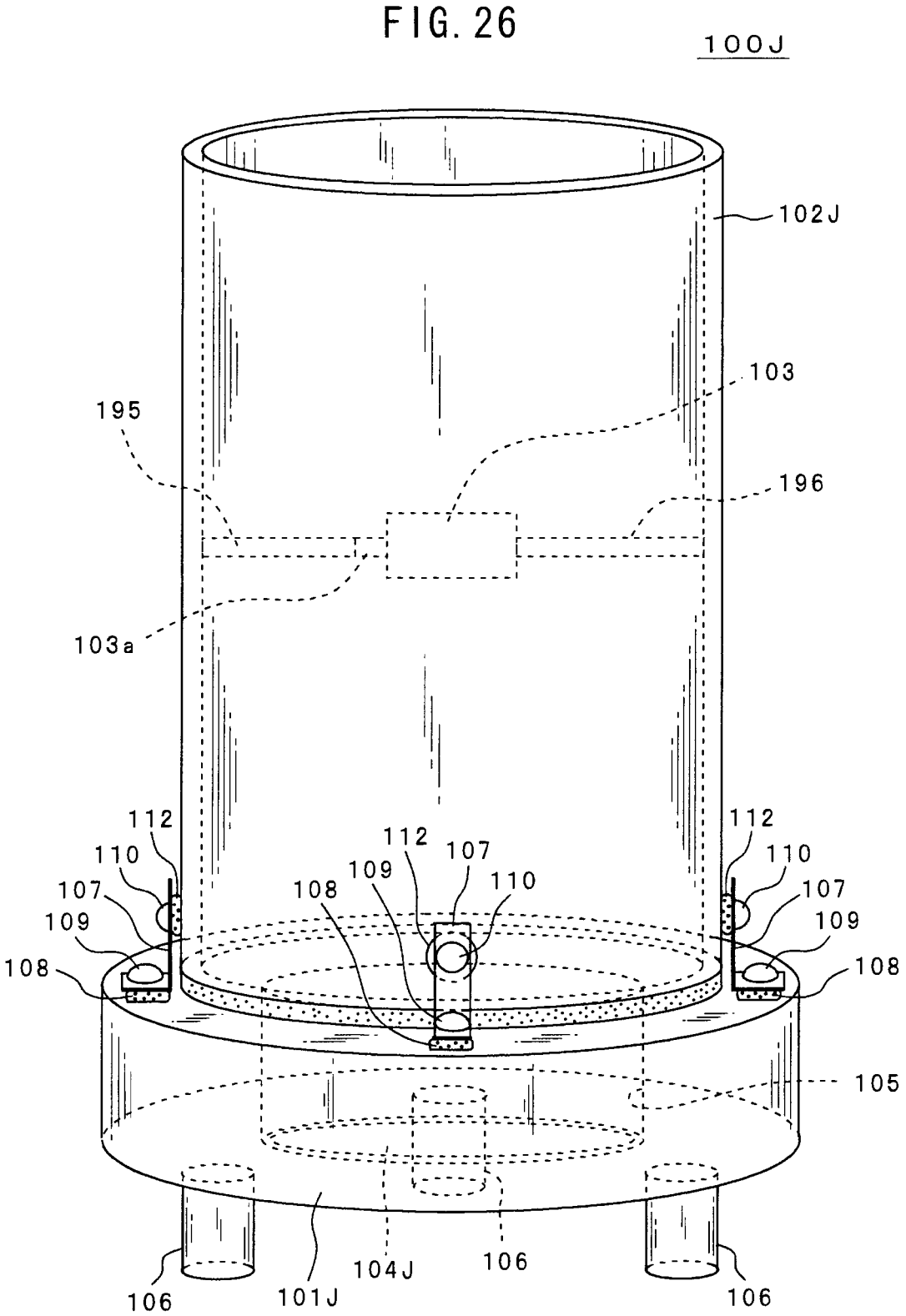
FIG. 26 is a perspective view of a speaker 100J according to a sixth embodiment of the invention.

The following will describe a speaker 100J according to a sixth embodiment of the invention. FIG. 26 shows a configuration of the speaker 100J according to the sixth embodiment of the invention. FIG. 26 is a perspective view of the speaker 100J. In FIG. 26, like reference numbers refer to like elements of FIG. 2, a detailed explanation of which will be omitted.

The magnetostrictive actuators 103 have vibrated with the lower end surface of the pipe member 102 in the speaker 100A shown in FIG. 2 while the magnetostrictive actuator 103 vibrates with an inside surface of a pipe member 102J in the speaker 100J. In other words, the driving rod 103*a* of the magnetostrictive actuator 103 is attached to the inside surface of the pipe member 102J through a rod-like vibration-transmission-member 195. A main body of the magnetostrictive actuator 103 is attached to the inside surface of the pipe member 102J through a rod-like fixed member 196.

In this embodiment, an end of the vibration-transmission-member 195 is adhered to a tip of the driving rod 103*a* as well as the other end thereof is adhered to the inside surface of the pipe member 102J. An end of the fixed member 196 is adhered to the main body of the magnetostrictive actuator 103 as well as the other end thereof is adhered to the inside surface of the pipe member 102J. In this moment, the vibration-transmission-member 195, the magnetostrictive actuator 103, and the fixed member 196 are arranged so that they can be aligned with each other.

Since the magnetostrictive actuator 103 provided inside the pipe member 102J vibrates with the inside surface of the pipe member 102J in the speaker 100J as described above, no magnetostrictive actuator is provided on the base casing 101J. Namely, the base casing 101J of this speaker 100J is different from the base casing 101A of the speaker 100A in that hollows 114 each for containing the magnetostrictive actuator 103 are not formed. How to attach the pipe member 102J to the base casing 101J and how to attach the speaker unit 104J to the base casing 101J are similar to how to attach them to the base casing 101A in the speaker 100A shown in FIG. 2.

Remaining parts of the speaker 100J shown in FIG. 26 are similar to those of the speaker 100A shown in FIG. 2.

The following will describe the operations of the speaker 100J shown in FIG. 26. The speaker unit 104J operates similar to the operations of that of the speaker 100A shown in FIG. 2. The following will describe the operations of the magnetostrictive actuator 103.

The magnetostrictive actuator 103 provided inside the pipe member 102J is driven by, for example, the high frequency range component SAH of the monaural acoustic signal SA, so that the driving rod 103*a* thereof can displace corresponding to the high frequency range component SAH. Such the displacement of the driving rod 103*a* enables the pipe member 102J to vibrate. Thus, an outer surface of the pipe member 102J emits an acoustic output sound corresponding to the high frequency range component SAH.

According to the speaker 100J as shown in FIG. 26, the magnetostrictive actuator 103 is driven on the basis of the high frequency range component SAH of the monaural acoustic signal SA so that the pipe member 102J as the acoustic diaphragm can emit the acoustic output sound of high frequency range based on the high frequency range component SAH. In such the reproduction of high frequency range, any large amplitude (large stroke) is not required, thereby enabling the pipe member 102J to emit any satisfied acoustic output sounds of high frequency range. Further, according to the speaker 100J shown in FIG. 26, the speaker unit 104J is driven on the basis of the low frequency range component SAL of the monaural acoustic signal SA so that the speaker unit 104J can emit an acoustic output sound of low frequency range based on the low frequency range component SAL. In such the reproduction of low frequency range, the speaker unit 104J can get any large amplitude (large stroke), thereby enabling the speaker unit 104J to emit any satisfied acoustic output sounds of low frequency range. This enables the speaker to emit a satisfied acoustic output sound of high and low frequency ranges as a whole.

According to the speaker 100J shown in FIG. 26, sound wave of positive phase, which has a low frequency range and is radiated from the front of the speaker unit 104J provided on a lower surface of the base casing 101J, radiates to outside through the bottom end thereof. Sound wave of negative phase, which has a low frequency range and is radiated from the back of the speaker unit 104J, propagates upwardly in the opening 105 and an interior of the pipe member 102J and radiates to outside through the upper end thereof. This enables a listener to feel even sound pressures at each position of the pipe member 102J in its longitudinal direction, thereby allowing the listener to spread an acoustic image along a whole length of the pipe member 102J to get a global acoustic image.

Figure 27:
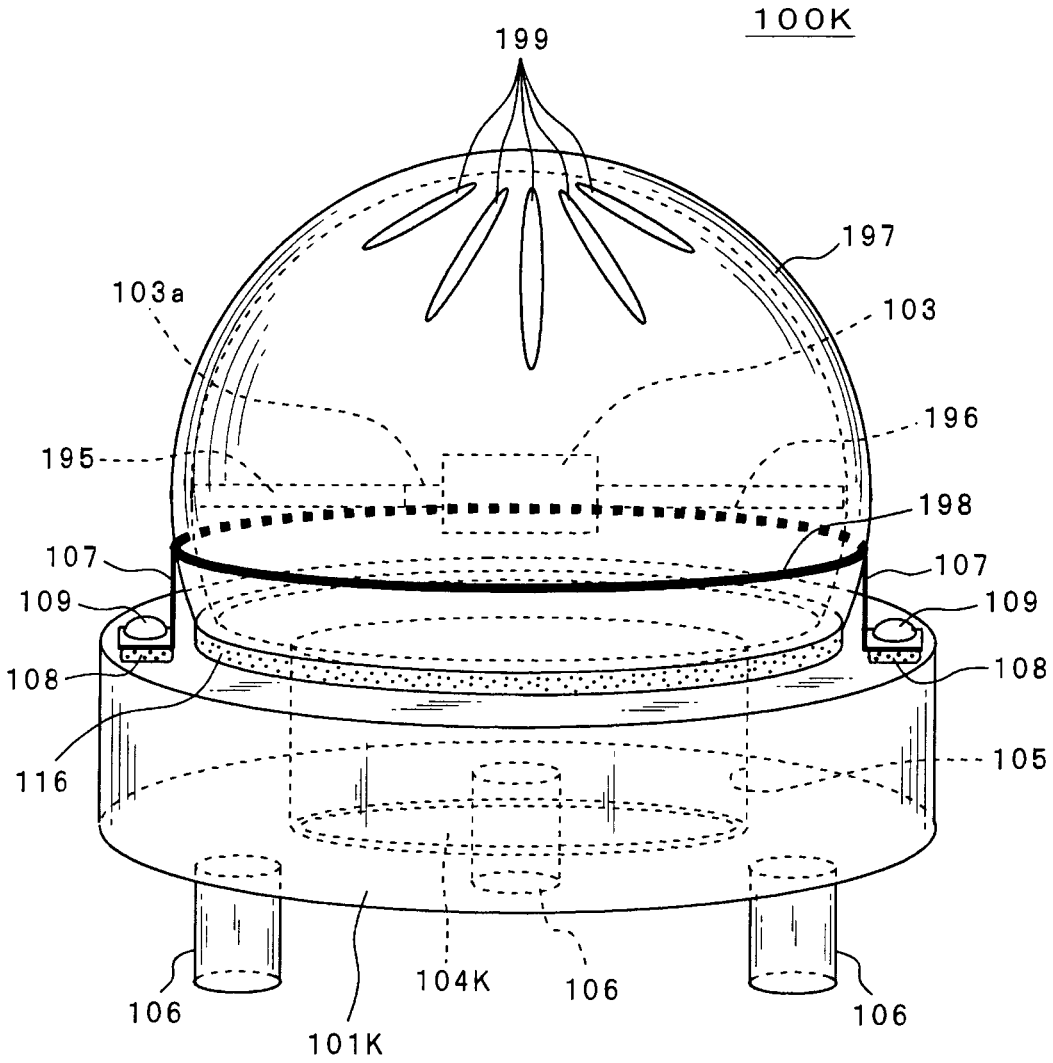
FIG. 27 is a perspective view of a speaker 100K according to a seventh embodiment of the invention.

The following will describe a speaker 100K according to a seventh embodiment of the invention. FIG. 27 shows a configuration of the speaker 100K according to the seventh embodiment of the invention. FIG. 27 is a perspective view of the speaker 100K. In FIG. 27, like reference numbers refer to like elements of FIG. 26, a detailed explanation of which will be omitted.

This speaker 100K includes a dome-like acoustic diaphragm 197 made of, for example, acrylic resin in place of the pipe member 102J of the speaker 100J shown in FIG. 26. The dome-like acoustic diaphragm 197 is arranged on a top surface of the base casing 101K with a ring-like supporting member 198 supporting the acoustic diaphragm 197. It is to be noted that this supporting member 198 is set on the base casing 101K by using L-shaped metal angles 107. In this embodiment, an end of each of the L-shaped metal angles 107 is welded and fixed to the supporting member 198.

Similar to a case of the pipe member 102J of the speaker 100J shown in FIG. 26, the magnetostrictive actuator 103 is arranged inside of this acoustic diaphragm 197 with the vibration-transmission-member 195 and the fixed member 196 supporting the magnetostrictive actuator 103. In this embodiment, an end of the vibration-transmission-member 195 is adhered to a tip of the driving rod 103*a* as well as the other end thereof is adhered to the inside surface of the acoustic diaphragm 197. An end of the fixed member 196 is adhered to the main body of the magnetostrictive actuator 103 as well as the other end thereof is adhered to the inside surface of the acoustic diaphragm 197. In this moment, the vibration-transmission-member 195, the magnetostrictive actuator 103, and the fixed member 196 are arranged so that they can be aligned with each other.

It is to be noted that slits 199 are formed on a roof portion of the dome-like acoustic diaphragm 197. These slits 199 are used for allowing sound wave of negative phase which a back of the speaker unit 104 radiates to radiating to outside therethrough.

Remaining parts of the speaker 100K shown in FIG. 27 are similar to those of the speaker 100J shown in FIG. 26.

The following will describe the operations of the speaker 100K shown in FIG. 27.

The speaker unit 104K is driven by, for example, the low frequency range component SAL of the monaural acoustic signal SA, so that the speaker unit 104K can emit a low acoustic output sound based on the low frequency range component SAL. Sound wave of positive phase, which is radiated from the front of the speaker unit 104K radiates to outside through the bottom of the base casing 101K. Sound wave of negative phase, which is radiated from the back of the speaker unit 104K, propagates upwardly in the opening 105 and an interior of the acoustic diaphragm 197 and radiates to outside through the slits 199 provided on the roof portion thereof.

The magnetostrictive actuator 103 provided inside the acoustic diaphragm 197 is driven by, for example, the high frequency range component SAH of the monaural acoustic signal SA, so that the driving rod 103*a* thereof can displace corresponding to the high frequency range component SAH. Such the displacement of the driving rod 103*a* enables the acoustic diaphragm 197 to vibrate. Thus, an outer surface of the acoustic diaphragm 197 emits an acoustic output sound corresponding to the high frequency range component SAH.

According to the speaker 100K shown in FIG. 27, the acoustic diaphragm 197 is driven on the basis of the high frequency range component SAH of the monaural acoustic signal SA so that the acoustic diaphragm 197 can emit the acoustic output sound of high frequency range based on the high frequency range component SAH. In such the reproduction of high frequency range, any large amplitude (large stroke) is not required, thereby enabling the acoustic diaphragm 197 to emit any satisfied acoustic output sound of high frequency range. Further, according to the speaker 100K shown in FIG. 27, the speaker unit 104K is driven on the basis of the low frequency range component SAL of the monaural acoustic signal SA so that the speaker unit 104K can emit an acoustic output sound of low frequency range based on the low frequency range component SAL. In such the reproduction of low frequency range, the speaker unit 104K can get any large amplitude (large stroke), thereby enabling the speaker unit 104K to emit any satisfied acoustic output sound of low frequency range.

According to the speaker 100K shown in FIG. 27, sound wave of positive phase, which is radiated from the front of the speaker unit 104K provided on a lower surface side of the base casing 101K, radiates to outside through the bottom end of the base casing 101K. Sound wave of negative phase, which is radiated from the back of the speaker unit 104K, propagates upwardly in the opening 105 and an interior of the acoustic diaphragm 197 and radiates to outside through the slits 199 provided on the roof portion thereof. This enables a listener to feel even sound pressures at each position of the dome-like acoustic diaphragm 197 in its outer surface, thereby allowing the listener to spread an acoustic image over a whole of outer surface of the acoustic diaphragm 197 to get a global acoustic image.

Figure 28:
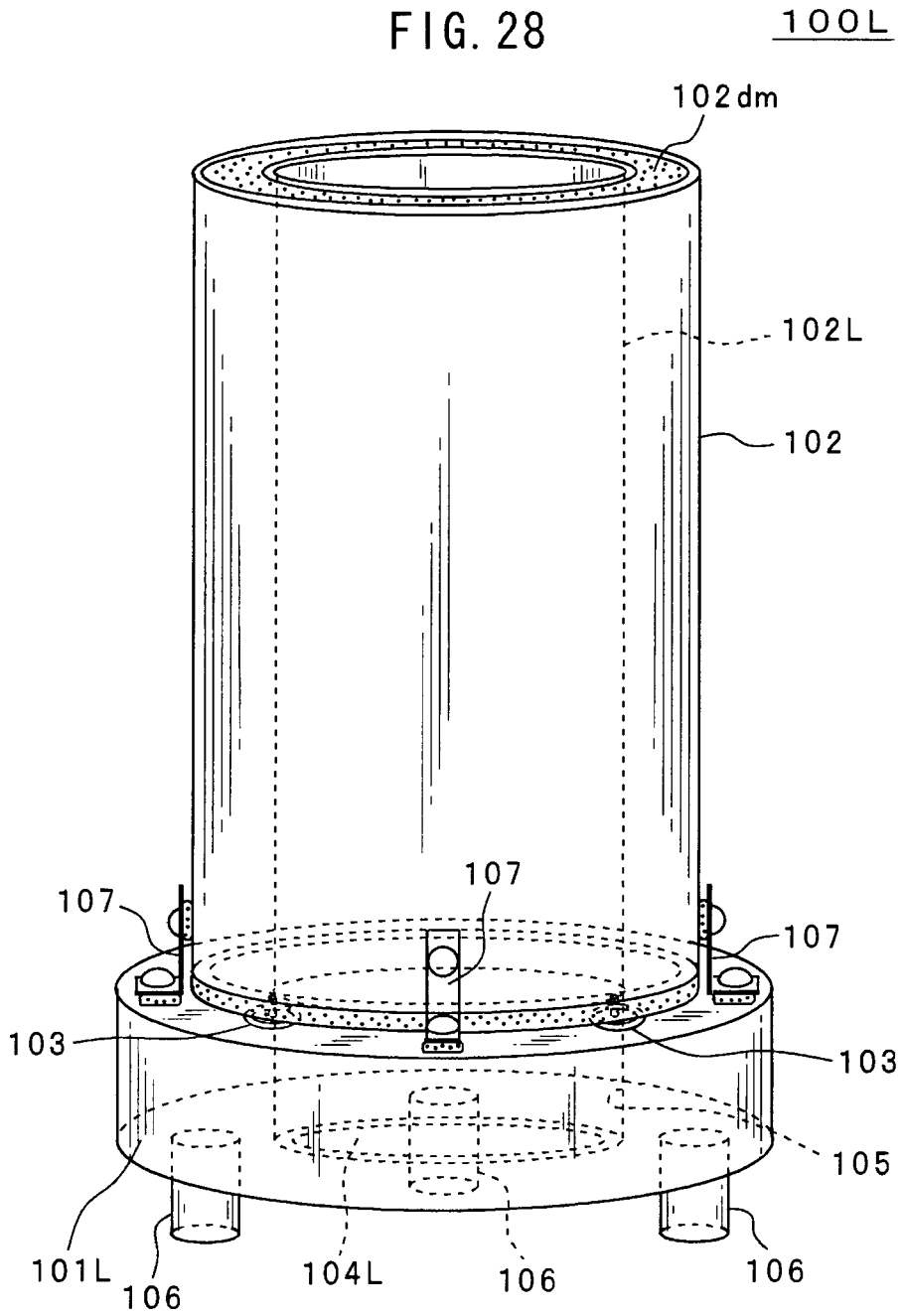
FIG. 28 is a perspective view of a speaker 100L according to an eighth embodiment of the invention.
Figure 29:
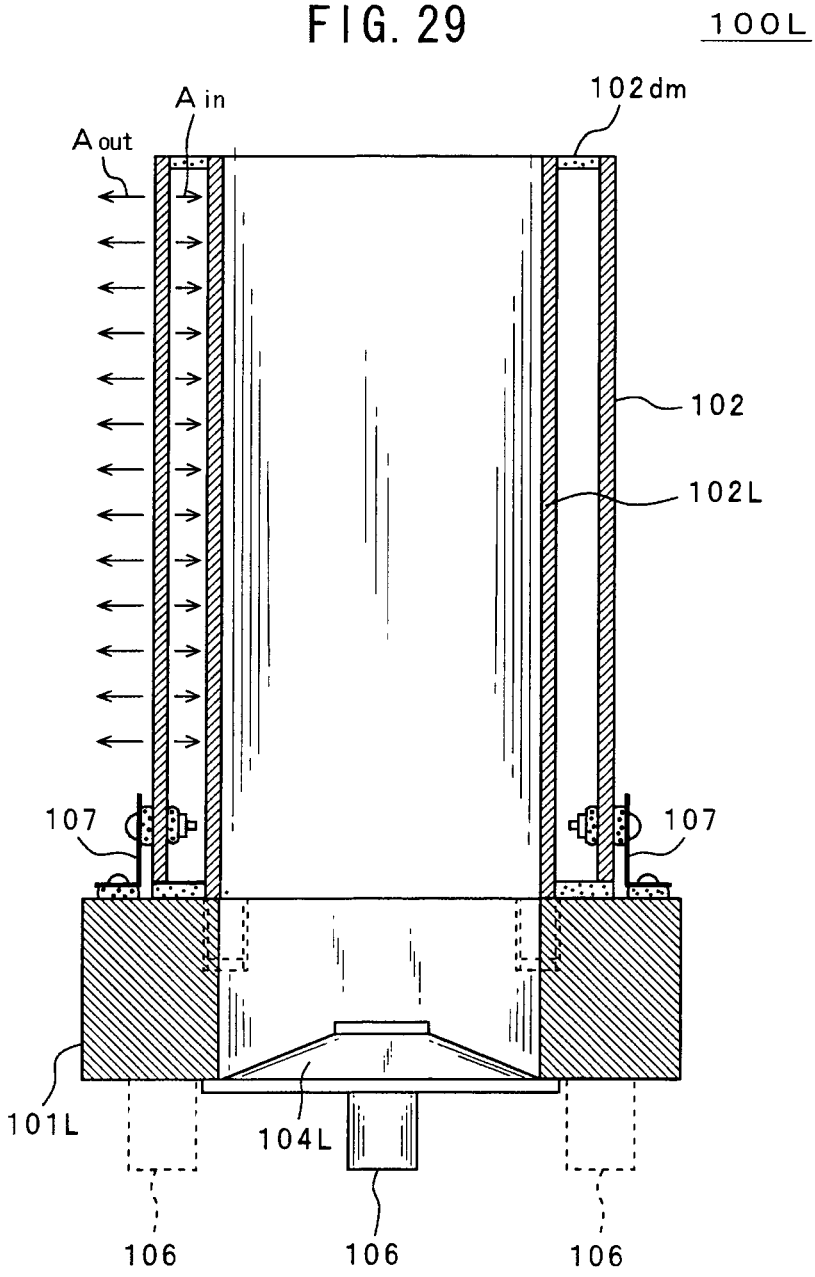
FIG. 29 is a vertical sectional view of the speaker 100L according to the eighth embodiment of the invention.

The following will describe a speaker 100L according to an eighth embodiment of the invention. FIGS. 28 and 29 show a configuration of the speaker 100L according to the eighth embodiment of the invention. FIG. 28 is a perspective view of the speaker 100L. FIG. 29 is a vertical sectional view thereof. In FIGS. 28 and 29, like reference numbers refer to like elements of FIGS. 2 and 3, a detailed explanation of which will be omitted.

In this speaker 100L, a pipe member 102L as a tubular member is arranged within an interior of the pipe member 102 as the acoustic diaphragm with the pipe member 102L being away from the pipe member 102. This pipe member 102L is made of, for example, transparent acrylic resin similar to a case of the pipe member 102. The pipe member 102 acting as the acoustic diaphragm has the thickness of, for example, 2 mm as described above while the pipe member 102L has a thickness of, for example, 5 mm to act as a rigid body.

The pipe member 102L is arranged on a top surface of the base casing 101L so that a lower end surface of the pipe member 102L can be adhered to the top surface of the base casing 101L as shown in FIG. 29. A diameter of this piper member 102L is almost similar to that of the opening 105 formed in the base casing 101L in order to act as a resonator. In this embodiment, a speaker unit 104L as sounding body is arranged corresponding to the pipe member 102L. Acoustic output sound (sound wave) of low frequency range, which is radiated from a back of the speaker unit 104L, radiates to outside from the upper end of the pipe member 102L through the opening 105 and an interior of the pipe member 102L.

It is to be noted that a damper member 102*dm* made of rubber materials or the like is arranged between the upper ends of the pipe members 102, 102L so that a space formed by these pipe members 102, 102L can be sealed.

Remaining parts of the speaker 100L shown in FIGS. 28 and 29 are similar to those of the speaker 100A shown in FIGS. 2 and 3.

The speaker 100L operates similar to the operations of the speaker 100A shown in FIGS. 2 and 3 except that the acoustic output sound radiated from the back of the speaker unit 104L radiates to outside from the upper end of the pipe member 102L through the opening 105 and the interior of the pipe member 102L.

According to the speaker 100L, it can attain any satisfied effects similar to those of the speaker 100A as shown in FIGS. 2 and 3 as well as since the pipe member 102L through which the acoustic output sound (sound wave) of low frequency range, radiated from a back of the speaker unit 104L, radiates to outside acts as a rigid body, any noisy vibrations are not propagated through the pipe member 102L, thereby enabling a satisfied reproduction to be implemented as a resonator. Further, the pipe member 102 acting as the acoustic diaphragm radiates outward acoustic output sound Aout (sound wave) and inward acoustic output sound Ain (sound wave), as shown in FIG. 29. Since the pipe member 102L is arranged inside the pipe member 102 as described above, a sealed space formed between the pipe members 102, 102L can intercept the noisy inward acoustic output sound Ain efficiently.

Figure 30:
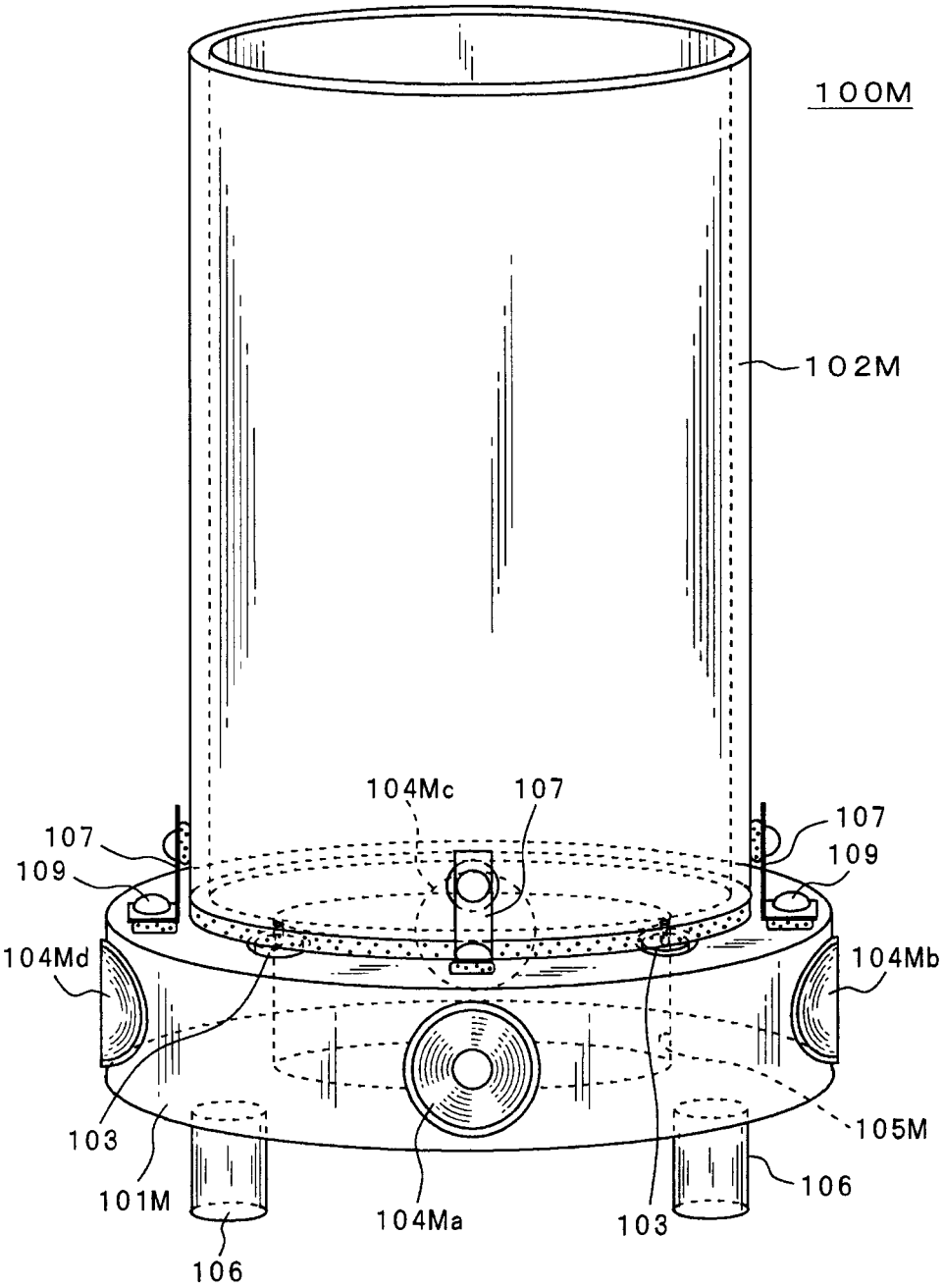
FIG. 30 is a perspective view of a speaker 100M according to a ninth embodiment of the invention.
Figure 31:
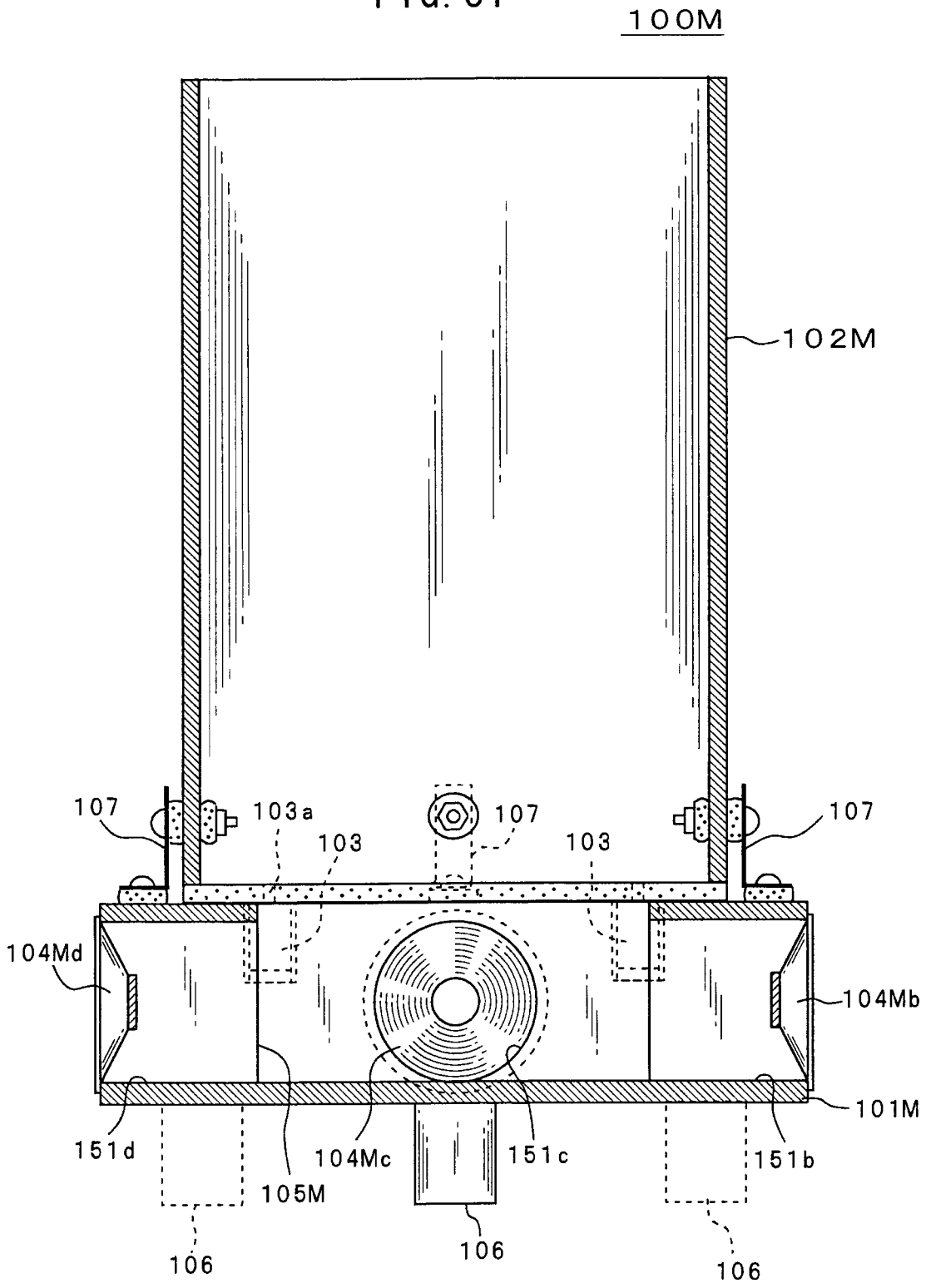
FIG. 31 is a vertical sectional view of the speaker 100M according to the ninth embodiment of the invention.
Figure 32:
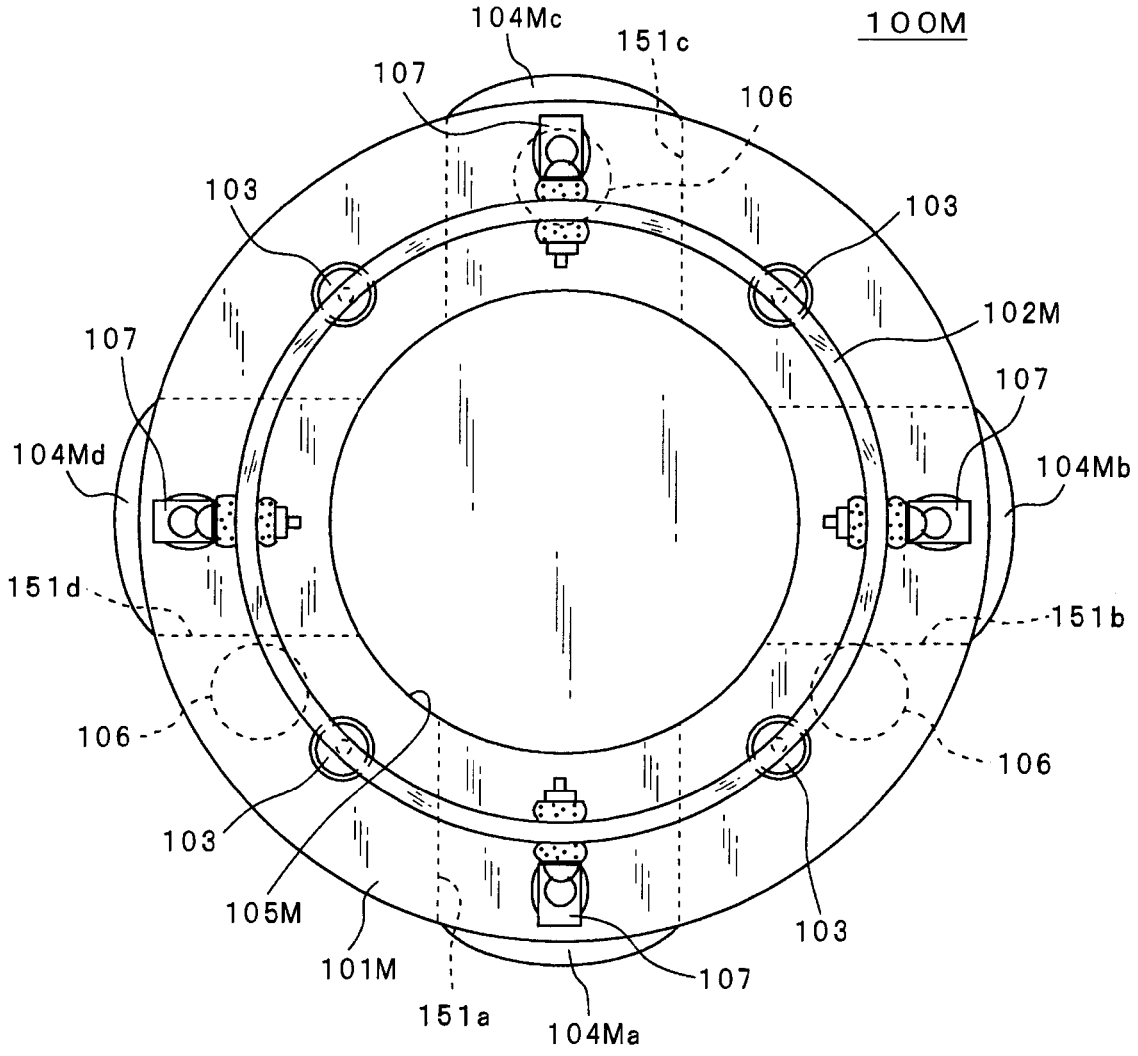
FIG. 32 is a top plan view of the speaker 100M according to the ninth embodiment of the invention.

The following will describe a speaker 100M according to a ninth embodiment of the invention. FIGS. 30 through 32 show a configuration of the speaker 100M according to the ninth embodiment of the invention. FIG. 30 is a perspective view of the speaker 100M; FIG. 31 is a vertical sectional view thereof; and FIG. 32 is a top plan view thereof. In FIG. 30 through 32, like reference numbers refer to like elements of FIGS. 2 through 5, a detailed explanation of which will be omitted.

In the speaker 100M, four speaker units 104Ma through 104Md are arranged in a disk-like base casing 101M around circumference thereof at a 90 degrees angular interval. These four speaker units 104Ma through 104Md constitute a speaker emitting acoustic output sound of a low frequency range within an audible frequency band and act as a woofer, similar to the speaker unit 104A of the speaker 100A as shown in FIG. 2. In this embodiment, each of the central axes of the four speaker units 104Ma through 104Md is orthogonal to the central axis of the pipe member 102M.

In the base casing 101M, an opening 105M corresponding to the opening 105 in the base casing 101A of the speaker 100A shown in FIG. 2 is formed. The opening 105M is different from the opening 105 in that the opening 105M is closed in its lower side. In the base casing 101M, through holes 151*a* through 151*d* for guiding sound wave radiated from each of the backs of the speaker units 104*a* through 104*d* are formed corresponding to positions of the base casing 101M to which the speaker units 104Ma through 104Md are attached.

The speaker units 104Ma through 104Md are driven on the basis of, for example, the same acoustic signal. Sound wave of positive phase radiated from a front of each of the speaker units 104Ma through 104Md radiates to outside through the side surface of the base casing 101M. Sound wave of negative phase radiated from a back of each of the speaker units 104Ma through 104Md radiates to outside from the upper end of the pipe member 102M through each of the through holes 151*a* through 151*d*, the opening 105M, and an interior of the pipe member 102M. In this embodiment, the pipe member 102M also acts as a resonator similar to that of the speaker 100A shown in FIG. 2, thereby enabling any massive sound of low frequency range to be reproduced.

Remaining parts of the speaker 100M shown in FIGS. 30 through 32 are similar to those of the speaker 100A shown in FIGS. 2 through 5. The speaker 100M shown in FIGS. 30 through 32 operates similar to the operations of the speaker 100A shown in FIGS. 2 through 5.

According to the speaker 100M, it can attain any satisfied effects similar to those of the above speaker 100A. According to the speaker 100M, the four speaker units 104Ma through 104Md are arranged around the base casing 101M. Each speaker unit reproduces only a low frequency component thereof so that it has not any enough information on acoustic image localization relatively. Thus, if the pipe member 102M reproduces a high frequency component thereof, it is possible for the speaker 100M to have omni-directionality as a whole of the system and to localize an acoustic image on the pipe member 102M.

It is to be noted that although the four speaker units 104Ma through 104Md have been arranged around the base casing 101M in the above embodiment, the invention is not limited thereto. A number of the speaker units to be arranged are not limited.

Although, in the speakers 100A through 100D, 100H, 100L, and 100M according to the above embodiments, the driving rod 103*a* of each of the magnetostrictive actuators 103 has directly been attached to the lower end of each of the pipe members 102A, 102B, 102H, 102L, and 102M, the cup member 102C, and the acrylic plate 102D, the invention is not limited thereto. It is possible for the driving rod 103*a* to be indirectly attached to the acoustic diaphragm through an insert plate made of predetermined material. In an embodiment of this invention, the insert plate can be made of, for example, wood, aluminum, glass or the like. These materials have different characteristic vibration moods so that different tones can be given on the basis of the materials.

Although cases where the acoustic signal for driving the magnetostrictive actuator that vibrates with the acoustic diaphragm is different from the signal for driving the sounding body such as the speaker unit have been described in the above embodiments, the invention is not limited thereto. It is possible to use the same acoustic signal for driving the magnetostrictive actuator and the sounding body.

Although in the above embodiments, the magnetostrictive actuators have been used in the speaker as the actuator that vibrates with the acoustic diaphragm, this invention is not limited thereto. An electrodynamic actuator, a piezoelectric actuator or the like may be used as the actuator to constitute the speaker similar to each of the above embodiments.

Although in the above embodiments, the speaker units using electrodynamic actuator as the sounding body (transducer) have been used, this invention is not limited thereto. A speaker unit using a magnetostrictive actuator, a piezoelectric actuator or the like may be used as the sounding body.

According to the above embodiments of the invention, it is possible to obtain any satisfied acoustic output sound within an acceptable wide range including a high frequency range and a low frequency range, so that this invention is applicable to a speaker or the like that is available for the audio-visual equipment.

It should be understood by those skilled in the art that various modifications, combinations, sub-combinations and alternations may occur depending on design requirements and other factors insofar as they are within the scope of the appended claims or the equivalents thereof.

What is claimed is:

1. A speaker comprising:

an tubular acoustic diaphragm;

an actuator that is driven based on a first acoustic signal, said actuator containing a transmission portion that transmits a displacement output of the actuator to the tubular acoustic diaphragm, said transmission portion being attached to the tubular acoustic diaphragm either directly or indirectly;

a base casing for holding the actuator, the base casing including a cylindrical opening passing through it at a center portion thereof, the cylindrical opening being connected to an interior of the tubular acoustic diaphragm, and a sounding body that is driven based on a second acoustic signal, said second acoustic signal being identical to or different from the first acoustic signal, the sounding body being positioned at the cylindrical opening of the base casing, wherein a direction of a center axis of the sounding body is identical to that of a center axis of the tubular acoustic diaphragm.

2. The speaker according to claim 1, wherein the actuator vibrates with the tubular acoustic diaphragm by at least its component of vibration along a direction of a plane of the tubular acoustic diaphragm.

3. The speaker according to claim 1, wherein the tubular acoustic diaphragm contains an end surface; and wherein the actuator vibrates with the tubular acoustic diaphragm by at least its component of vibration orthogonal to the end surface of the tubular acoustic diaphragm.

4. The speaker according to claim 1 further comprising plural actuators, wherein the transmission portions of the plural actuators are respectively attached to the tubular acoustic diaphragm at different positions thereof.

5. The speaker according to claim 1, wherein the acoustic diaphragm contains a tube shape; wherein the sounding body is arranged on one end side of the tubular acoustic diaphragm; and wherein a first sound wave being radiated from the sounding body is radiated out through the interior of the tubular acoustic diaphragm.

6. The speaker according to claim 5, wherein the first sound wave being radiated from the sounding body is radiated from one end and the other end of the tubular acoustic diaphragm.

7. The speaker according to claim 5, wherein the tubular acoustic diaphragm contains different diameters of its circular cross sections, said diameters being gradually made larger along a direction where the first sound wave being radiated from the sounding body propagates.

8. The speaker according to claim 5, wherein a tubular member is arranged within the interior of the tubular acoustic diaphragm with the tubular member being away from the tubular acoustic diaphragm;

wherein the sounding body is arranged corresponding to the tubular member; and wherein a second sound wave being radiated from the sounding body is radiated out through an interior of the tubular member.

9. The speaker according to claim 1, wherein the tubular acoustic diaphragm contains a cup shape;

wherein the transmission portion of the actuator is attached to an open end surface of the tubular acoustic diaphragm;

wherein the sounding body is arranged on the open end surface side of the tubular acoustic diaphragm; and wherein the tubular acoustic diaphragm acts as an air chamber for the sounding body.

10. The speaker according to claim 9, wherein a direction of a center axis of the sounding body is identical to that of a center axis of the tubular acoustic diaphragm.

* * * * *